US006302179B1

(12) United States Patent
Miller

(10) Patent No.: US 6,302,179 B1
(45) **Date of Patent: *Oct. 16, 2001**

(54) MODULAR ROLL-UP PARTITION SYSTEM WITH TENSION ADJUSTMENT MECHANISM

(76) Inventor: James V. Miller, 893 Maryknoll Cir., Glen Ellyn, IL (US) 60137

( * ) Notice: Subject to any disclaimer, the term of this patent is extended or adjusted under 35 U.S.C. 154(b) by 0 days.

This patent is subject to a terminal disclaimer.

(21) Appl. No.: 09/276,186

(22) Filed: Mar. 25, 1999

Related U.S. Application Data

(63) Continuation-in-part of application No. 09/128,903, filed on Aug. 4, 1998, which is a continuation-in-part of application No. 09/008,621, filed on Jan. 16, 1998.

(51) Int. Cl.[7] ..... E06B 9/17
(52) U.S. Cl. ..... 160/23.1; 160/133
(58) Field of Search ..... 160/23.1, 31, 133, 160/191, 242, 315, 318; 242/375.1, 375.3

(56) References Cited

U.S. PATENT DOCUMENTS

| | | | | |
|---|---|---|---|---|
| Re. 11,067 | * | 3/1890 | Griswold . | |
| 667,302 | * | 2/1901 | Edwards | 160/315 |

(List continued on next page.)

FOREIGN PATENT DOCUMENTS

| | | | | |
|---|---|---|---|---|
| 3132036 | * | 3/1983 | (DE) | 160/368.1 |
| 41 05 975 | | 8/1992 | (DE) . | |
| 196 12 245 | | 10/1997 | (DE) . | |
| 0 652 350 | | 5/1995 | (EP) . | |
| 0 784 145 | | 7/1997 | (EP) . | |
| 2 358 859 | | 2/1978 | (FR) . | |
| 2 662 466 | | 11/1991 | (FR) . | |
| 2 697 280 | | 4/1994 | (FR) . | |
| 640611 | | 7/1950 | (GB) . | |
| WO 90/15216 | | 12/1990 | (WO) . | |
| WO 00/08288 | | 2/2000 | (WO) . | |

OTHER PUBLICATIONS

English–language abstract of France 2 697 280 (Item B1).
Alulux, "The Aluminum–Shutter–Complete Range," 1995 Price List, cover and Facing Caps price listing page.
International Door & Operator Industry™ Magazine, Jan. 1999, cover, table of contents, Clopay advertisement: Ex–Set Torsion Spring System, and advertiser index.
Imbac, "Accessories for Rolling Shutters," 1998 Catalog, Cover and pp. III–XIII, 23–30, and 199–239.
Roller Star, Aluminum Roll–Up Doors, 1995 Price List, pp. 1–17.

(List continued on next page.)

*Primary Examiner*—Blair M. Johnson
(74) *Attorney, Agent, or Firm*—Howrey, Simon, Arnold & White LLP

(57) ABSTRACT

The present invention is directed to a modular roll-up partition assembly, such as a rolling protective shutter, implementing an improved tension adjustment mechanism for torsion springs used in roll-up partition assemblies. In one embodiment, the roll-up partition assembly of the present invention includes a tension adjustment mechanism to adjust the tension of a torsion spring connected between a support rod and the partition support member. The tension adjustment mechanism rotates the support rod to move the end of the torsion spring connected to the rod relative to the end of the torsion spring connected to the partition support member. Unlike previous roll-up partition assemblies which permitted adjustment of the torsion spring tension only in increments of a full rotation of the support member, the tension adjustment mechanism facilitates fine adjustment of the torsion spring in increments of less than a full rotation of the partition support member.

7 Claims, 21 Drawing Sheets

U.S. PATENT DOCUMENTS

| | | | | |
|---|---|---|---|---|
| 1,825,198 | * | 9/1931 | Negrini | 160/242 |
| 1,937,209 | * | 11/1933 | Traut | 160/315 |
| 1,947,070 | * | 2/1934 | Traut | 160/315 |
| 2,007,050 | * | 7/1935 | Hirschmann . | |
| 2,696,250 | * | 12/1954 | Michelman | 160/315 |
| 3,734,161 | | 5/1973 | Pierce | 160/133 |
| 4,294,302 | | 10/1981 | Ricke, Sr. | 160/133 |
| 4,345,635 | | 8/1982 | Solomon | 160/133 |
| 4,519,434 | | 5/1985 | Forquer | 160/133 |
| 4,726,409 | | 2/1988 | Besler | 160/23 R |
| 4,738,296 | | 4/1988 | Hatch | 160/133 |
| 4,807,687 | | 2/1989 | Finch et al. | 160/133 |
| 4,921,033 | | 5/1990 | Finch et al. | 160/133 |
| 4,930,563 | | 6/1990 | Finch et al. | 160/271 |
| 4,974,658 | | 12/1990 | Komatsu et al. | 160/310 |
| 5,070,925 | | 12/1991 | Paule | 160/133 |
| 5,172,744 | | 12/1992 | Finch et al. | 160/133 |
| 5,253,693 | | 10/1993 | Marlatt et al. | 160/7 |
| 5,365,990 | | 11/1994 | Ueda | 160/23.1 |
| 5,419,010 | | 5/1995 | Mullet | 16/198 |
| 5,575,322 | | 11/1996 | Miller | 160/133 |
| 5,577,544 | | 11/1996 | Carper et al. | 160/191 |
| 5,615,723 | | 4/1997 | Carper | 160/191 |
| 5,632,063 | | 5/1997 | Carper et al. | 16/198 |
| 5,636,678 | | 6/1997 | Carper et al. | 160/191 |
| 5,655,587 | | 8/1997 | Kraler | 160/31 |
| 5,657,805 | | 8/1997 | Magro | 160/133 |

OTHER PUBLICATIONS

Sweet's General Building & Renovation 1993 Catalog File, Solaroll® Shade & Shutter Corporation, Catalog 561, B505, 08667/SOL/ BuyLine 1828, pp. 1–40.

Sweet's General Building & Renovation 1993 Catalog File, Rolladen®, Rolladen® Rollshutters, B499, 08667/ROL, BuyLine 6493, pp. 1–8.

Sweet's General Building & Renovation 1996 Catalog File, Hearst Awning Company, Inc., "Accordion Shutters/Removable Shutters," B492, 08667/HUR, BuyLine 6400, pp. 1–8.

Sweet's General Building & Renovation 1996 Catalog File, Roll–a–way, "Insulating Security Shutters," B500, 08667/ROM, BuyLine 1239, pp. 1–8.

International Search Report, International Application No. PCT/US99/17686, mailed Feb. 24, 2000.

* cited by examiner

MODULAR ROLL-UP PARTITION SYSTEM WITH TENSION ADJUSTMENT MECHANISM

CROSS REFERENCE TO RELATED APPLICATION

This application is a continuation-in-part of U.S. application Ser. No. 09/128,903, filed Aug. 4, 1998, which is a continuation-in-part of U.S. application Ser. No. 09/008,621, filed Jan. 16, 1998.

BACKGROUND OF THE INVENTION

The present invention is directed to a roll-up partition system assembly which has a protective partition for covering a window or door opening that may be rolled up into a housing when not in use. More particularly, the present invention is directed to a modular assembly implementing an improved tension adjustment mechanism for roll-up partition systems. The embodiments disclosed herein illustrated the various aspects of the present invention applied to one particular type of roll-up partition system: rolling protective shutters formed from a plurality of interconnected slats. It will be apparent to those of ordinary skill in the art that the present invention has application in other systems wherein a partition member is coupled to and rolls up onto a support member within a housing, such as roll-up doors, roll-up grills, roll-up gates and the like. The application of the present invention to the various types of roll-up partition systems is contemplated by the inventor.

One type of roll-up partition system is a rolling protective shutter. Rolling protective shutters are conventional and are used to provide protection against extreme weather conditions and to deter theft, for example. One such rolling protective shutter is disclosed in U.S. Pat. No. 4,345,635 to Solomon. As shown in FIGS. 1 and 2 of that patent, the Solomon shutter is composed of a plurality of elongate slats, each of which has a pair of circular ribs attached to its sides. The slats are interconnected by a plurality of elongate hinges, each of which has a pair of circular apertures in which the circular ribs of the slats are disposed. When the Solomon shutter is unrolled to its protective position, each of the slats in the shutter is disposed vertically with the ends of the slats disposed with guide channels or side tracks on either side of the opening. When not in use, the Solomon shutter may be rolled up into a housing disposed at the upper end of the protective shutter.

Another type of rolling protective shutter is disclosed in U.S. Pat. No. 5,365,990 to Ueda. As shown in FIGS. 2 and 3 of that patent, the Ueda shutter is composed of a plurality of slats, each of which has an upper rearward hook extending longitudinally along the upper edge of the slat and a lower U-shaped recess extending longitudinally along the lower edge of the slat. The recess has a forward horizontal projection on a rear edge and extending longitudinally so that when the lower slat moves down under gravity, the hook of the lower slat bears on the horizontal projection of the upper slat. The Ueda shutter may be rolled up and unrolled in a similar manner as the Solomon shutter.

In rolling shutter systems such as the Solomon and Ueda shutters, a portion of the shutter must remain within the side tracks to prevent the shutter from completely rolling up onto the take-up roll within the shutter housing. In some applications, the bottommost slat has a projection, such as a handle, extending outwardly from the shutter. One way to stop the bottom of the shutter from entering the housing is to size the opening in the housing through which the shutter passes narrow enough so that the projection hits the housing. The bottom of the shutter will stop short of entering the housing, but in many installations the housing is fabricated from sheet metal that is easily bent after repeated impacts by the projection or if the shutter is rolled up too rapidly.

In another alternative for stopping the bottom of the shutter, metal braces are attached to the side tracks and extend inwardly into the opening so that they engage the projection as the shutter is rolled up. Although the braces are stronger than the sheet metal housing, the handle and the braces can be damaged from repeated metal-on-metal impacts. Both the projection and the braces can be bent, gouged or broken, thereby increasing the possibility that the entire shutter will roll up into the housing and causing deterioration of the appearance of the shutter system. Additionally, the shutter may make a loud bang when the metal projection impacts the metal braces. Therefore, there is a need for a better stopping mechanism that is reliable and adjustable, and will preserve the appearance of the shutter system.

The most common mounting application for shutter systems is a surface mount for the housing and shutter tracks on either the inside or the outside of the opening. In other mounting applications, the housing and side tracks are mounted between the walls or jambs that define the opening. In these applications, a recess mount may be used wherein the ends of the side tracks are mounted directly to the walls or jambs. However, if the walls or jambs are not plumb and flat, or if the dimensions of the opening are even slightly off, the side tracks may not mount flush against the wall or jamb, the shutter may get bound up in the tracks or, alternatively, come out of the tracks, or the shutter system may not fit within the opening.

In an alternative to recess mounts, angle mounts are used wherein L-shaped angle brackets are used to mount the side tracks to the walls or jambs. When angle mounts are used, the measurements are not as critical because the angle bracket acts as a trim spacer that hides the space between the side track and the wall or jamb. One drawback to the angle mounts versus the recess mounts is that the heads of the fasteners used to attach the angle brackets are visible. Visible fastener heads may be acceptable for shutter systems mounted to building exteriors, but they may not be desired in interior applications. Therefore, a need exists for a cover for the angle brackets that hides the heads of the fasteners and provides a finished appearance to the angle mounted shutter system.

Another type of rolling protective shutter is disclosed in U.S. Pat. No. 5,575,322 to Miller. As shown, the shutter assembly includes a shutter support member mounted for rotation in a shutter housing. A rolling shutter composed of a plurality of individual slats is coupled to the shutter support member so that the shutter can be rolled up onto the shutter support member. A pair of shutter tracks extend downwardly from either end of the shutter housing. When the shutter is in its unrolled position, the ends of the slats are disposed within the tracks.

In shutter assemblies such as the one disclosed in the Miller patent, the shutter housing is integrally connected to each of the shutter tracks by a nipple that extends downwardly from the housing. The shutter housing is pre-assembled with the shutter and shutter support member mounted therein. The nipple is inserted into a channel in the shutter track to prevent movement of the housing with respect to the shutter track. Once both shutter tracks are attached to the housing, the entire assembly is tilted up against the frame of the opening, and the shutter tracks and housing are anchored to the frame.

The procedure for assembling and mounting the shutter assemblies as described above is adequate for shutters that are relatively light-weight. However, in installations requiring larger, heavier shutters, previous shutter assemblies present reliability and safety concerns. For example, the shutter housings are typically fabricated from sheet metal that may not be strong enough to anchor the housing and shutter to the wall. The weight of the shutter causes the housing to pivot about points of intersection of the housing and tracks leaving only the nipple, which is not designed as a load bearing component, to resist the pivoting of the housing and shutter. A similar problem is encountered where the shutter cannot be anchored in studs and the shutter housing is anchored to drywall. Additionally, the fully assembled shutter assembly is top-heavy and awkward to mount to the wall. Until the shutter housing is anchored to the wall, the installers risk having the nipples break off and the housing and shutter crash down on them. Moreover, the cost of packing and shipping the shutter assemblies is increased because the container must accommodate the outwardly extending nipples, thereby increasing the size of the container. Therefore, a need exists for a modular shutter assembly that is stronger, easier and safer to install, and less costly to ship than previous shutter assemblies.

Roll-up partitions in general, and rolling protective shutters in particular, typically incorporate one or more torsion spring assemblies to assist in rolling and unrolling the shutters manually or by a powered opening device. In one arrangement, the assembly is a self-contained modular unit having a rod surrounded by a coiled torsion spring. One end of the rod includes a rod support that is rotatable about the rod, and a spring plate rigidly fixed to the rod and to the proximate end of the torsion spring to prevent rotation of the end of the torsion spring relative to the rod. The other end of the rod includes a spring drive that is rotatable about the rod and rigidly fixed to the other end of the torsion spring. The assembly is inserted into the shutter support member with one end of the rod rigidly fixed to the shutter housing. The rod support and spring drive engage the interior of and rotate with the shutter support member. When the shutter is unrolled, the torsion spring is wound tighter, thereby providing additional torque to assist in lifting and rolling the shutter onto the shutter support member. During normal operation of the rolling protective shutters, the torsion spring exerts a minimum torque when the shutter is in the rolled position and a maximum torque when the shutter is in the unrolled position.

During installation, the torsion spring is wound to an initial tension by winding the shutter and shutter support member around the rod prior to inserting the free end of the shutter into the shutter tracks. The free end of the shutter is inserted into the tracks and a retention mechanism retains the free end of the shutter within the tracks. If the tension on the torsion spring is too high or too low, the retention mechanism is removed and the shutter and shutter support member are wound or unwound to adjust the tension in the torsion spring. In this adjustment process, the amount of disassembly required is not insubstantial. Additionally, the tension in the spring is adjustable in increments of one full rotation of the shutter support member. In some applications, an acceptable torsion spring tension may only be attainable with a partial rotation of the shutter support member. Therefore, a need exists for an improved tension adjustment mechanism for torsion springs in rolling protective shutters that minimizes or eliminates the disassembly of the shutter assembly and allows tension adjustment in increments of less than a full rotation of the shutter support member.

SUMMARY OF THE INVENTION

The present invention is directed to a modular roll-up partition assembly, such as a rolling protective shutter, implementing an improved tension adjustment mechanism for torsion springs used in roll-up partition assemblies. In one aspect, the roll-up partition assembly of the present invention includes a tension adjustment mechanism to adjust the tension of a torsion spring connected between a support rod and the partition support member. The tension adjustment mechanism rotates the support rod to move the end of the torsion spring connected to the rod relative to the end of the torsion spring connected to the partition support member. Unlike previous roll-up partition assemblies which permitted adjustment of the torsion spring tension only in increments of a full rotation of the support member, the tension adjustment mechanism facilitates fine adjustment of the torsion spring in increments of less than a full rotation of the partition support member.

The roll-up partition assembly further includes a rod locking mechanism that alternately engages the rod to prevent rotation of the rod, and disengages the rod to permit rotation.

In another aspect, the roll-up partition assembly according to the present invention has a modular design that facilitates safer and less cumbersome installation of the roll-up partition assembly. The partition support member and partition member are mounted to a pair of mounting plates to form a partition cassette. The partition housing is adapted for insertion and removal of the partition cassette without disassembling the partition housing from the side tracks.

In one embodiment, the housing includes a pair of end caps disposed at either end, each having an end plate with a track mounted thereon. In addition, a pair of rollers are attached to each mounting plate. The partition cassette is inserted in the housing, with the rollers disposed within the tracks.

The features and advantages of the invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENT

Figure 1:
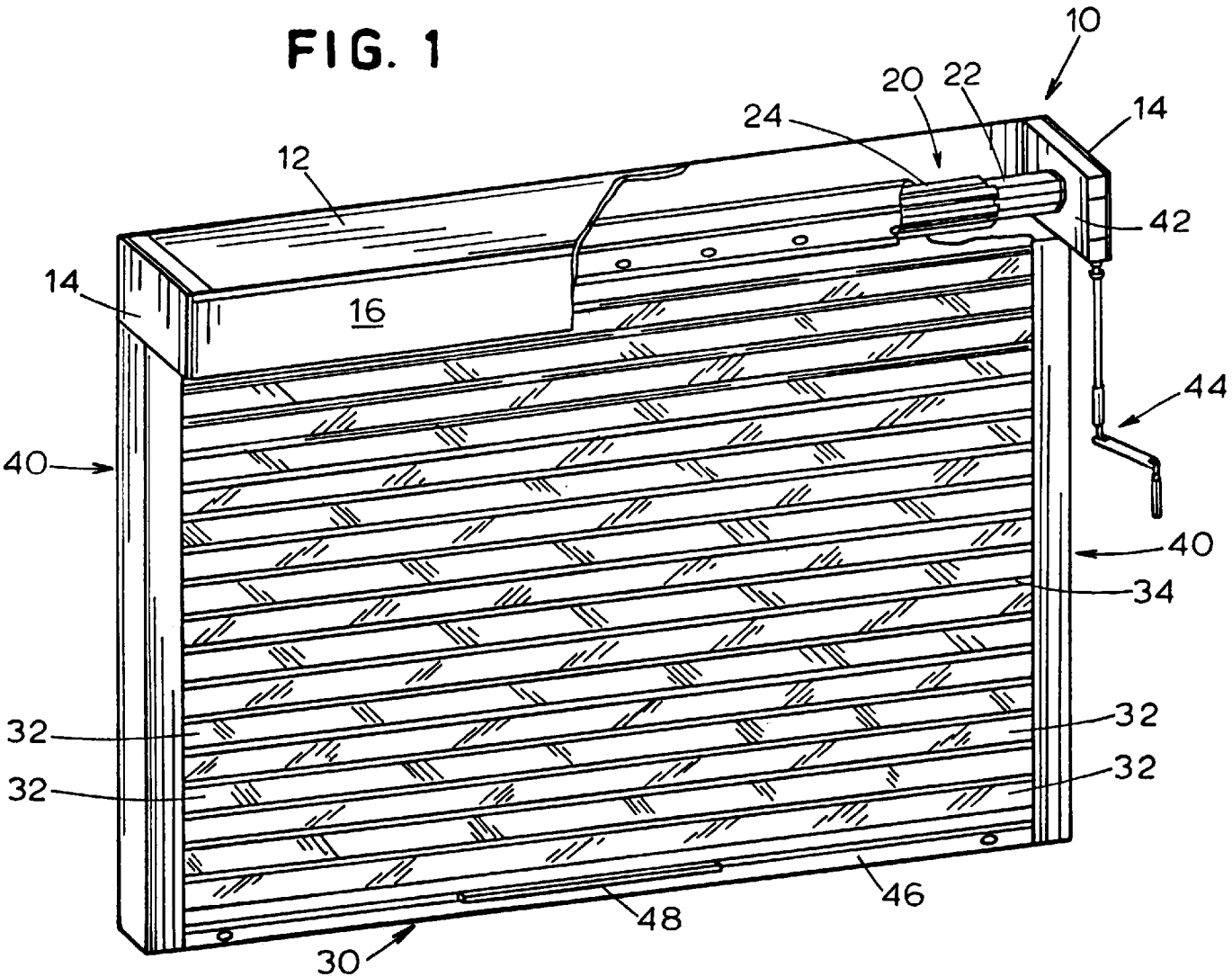
FIG. 1 is a perspective view of a rolling shutter assembly that can implement the present invention.
Figure 2:
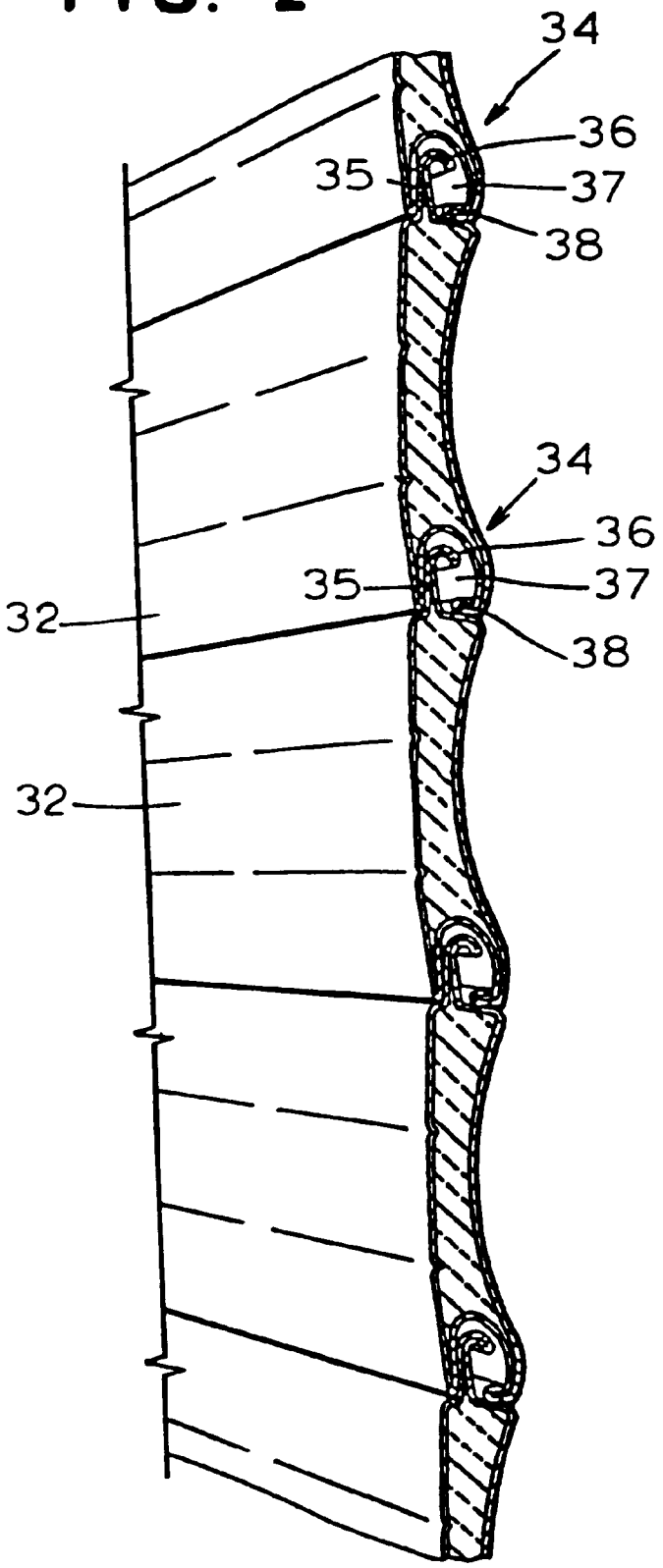
FIG. 2 is a fragmentary perspective view of a portion of the shutter of the shutter assembly of FIG. 1.
Figure 3:
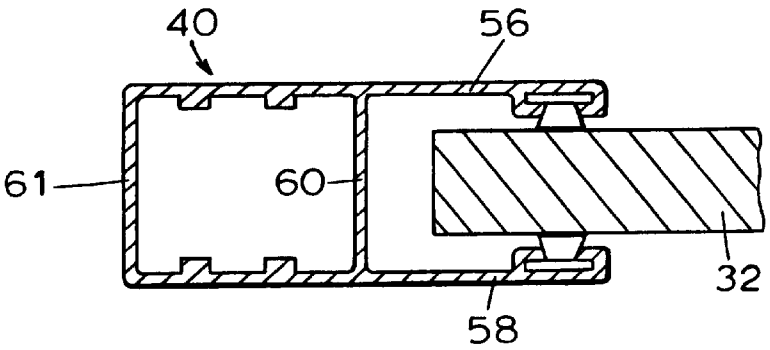
FIG. 3 is a cross-sectional top view of a portion of the shutter assembly of FIG. 1.

One type of roll-up partition system, rolling shutter assembly 10, that may implement the present invention is shown in FIGS. 1–3. Referring to FIG. 1, the shutter assembly 10 has a shutter housing which includes a top wall 12, a pair of side walls 14, and a front wall 16. A shutter support member 20 is mounted for rotation within the shutter housing. The support member 20 includes a generally cylindrical central shaft 22 and a plurality of mounting members 24 fixed to the shaft 22.

The upper end of a rolling shutter 30 is coupled to the mounting members 24. Alternatively, however, the mounting members 24 may be omitted and the rolling shutter 30 mounted directly to the shaft 22. The shutter 30 is composed of a plurality of individual, elongate slats 32. One example of a configuration of slats 32 is illustrated in FIG. 2. The slats 32, each of which is substantially flat, having two substantially planar side portions, and may be composed of steel, are interconnected by a plurality of hinges 34, each of which joins together a pair of adjacent slats 32.

Each of the slats 32 includes an upward projection 35 extending longitudinally along the upper edge of the slat 32 and having a rearwardly and downwardly extending hook 36 at the top. Each of the slats 32 further includes a downward facing U-shaped recess 37 extending longitudinally along the lower edge of the slat 32 and having a forward horizontal projection 38 formed on the rear edge of the recess 37. The hook 36 of a lower slat 32 and the recess 37 and projection 38 of an upper slat 32 interlock to form each hinge 34. Other configurations of slats 32 and interconnecting hinges 34, such as the configuration of the Solomon shutters, are well known in the art and are contemplated by the inventor as having use with the present invention.

Referring back to FIG. 1, the ends of the slats 32 are disposed within a pair of shutter tracks 40. The shutter assembly 10 has a gearbox 42 which interconnects the rotatable shaft 22 with a hand crank 44 via a conventional gear assembly (not shown). When mounted to protect a window or other opening, the shutter tracks 40 of the shutter assembly 10 are positioned on either side of the opening and the shutter housing is positioned over the top of the opening. Alternatively, in some applications, the side tracks 40 and shutter housing are positioned within the opening. When the shutter 30 is not in use, it is rolled up on the shutter support member 20 via the hand crank 44 so that it is at least partially enclosed by the shutter housing. The hand crank 44 may be disposed on a rear portion of the shutter assembly 10 so that the shutter 30, when attached over a window for example, can be unrolled from inside the window. Alternatively, when the gearbox 42 is not provided, the support member 20 may include a torsion spring. The shutter 30 may be rolled and unrolled with the assistance of the tension in the spring by exerting a force on a bottommost slat 46 by grasping a handle 48 that extends longitudinally along the slat 46 and outwardly from the shutter 30. Other drive mechanism, such as straps and tubular operators are well known to those of ordinary art and are contemplated by the inventor as having use with the present invention.

The structure of one example of previously known shutter tracks 40 is illustrated in FIG. 3, which is a horizontal cross-section of one of the shutter tracks 40. Each shutter track 40 is composed of a pair of side walls 56, 58 joined by an end wall 60. A structural support member 62 is disposed on the outside of the end wall 60 to provide additional structural support to the shutter track 40, and to receive a support member (not shown), commonly referred to as a nipple, that extends downwardly from the side wall 14 of the housing to secure the housing to the side track 40. In this configuration, the side walls 56, 58 and the end wall 60 define a first channel that receives the shutter 30, and the end wall 60 and the structural support member 61 define a second channel that receives the nipple when the housing is connected to the side track 40.

During the assembly of the protective shutters 10 described above, the shutters 30 are formed by sliding the hooks 36 of the lower slats 32 into the U-shaped recesses 37 of the upper slats 32. After the shutter 30 is assembled in that fashion, it is disposed between the side tracks 40, which prevent the hooks 36 from sliding out of the U-shaped recesses 37.

Although the slats described above are substantially flat, they could be provided with a curved shape to facilitate rolling up of the shutter. Other drive mechanisms for rolling the shutter up may also be used. For example, instead of having a hand crank fixed to a gearbox, the drive mechanism may comprise an electric motor directly coupled to the shaft on which the shutter rolls up. Instead of being integrally formed with the shutter slats, the hooks and U-shaped recesses described above could be separate components connected thereto, such as by bolting or riveting. Instead of hooks and recesses, other locking members having different structures could be used to form the hinges.

Figure 5:
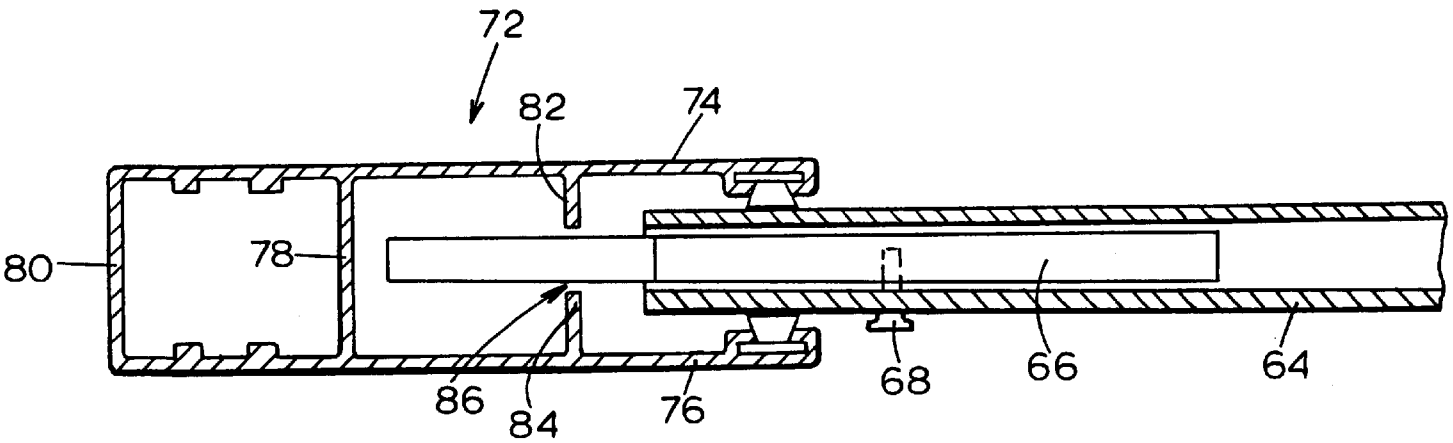
FIG. 5 is a cross-sectional top view of a portion of the shutter assembly of FIG. 4 taken along line 5—5.
Figure 4:
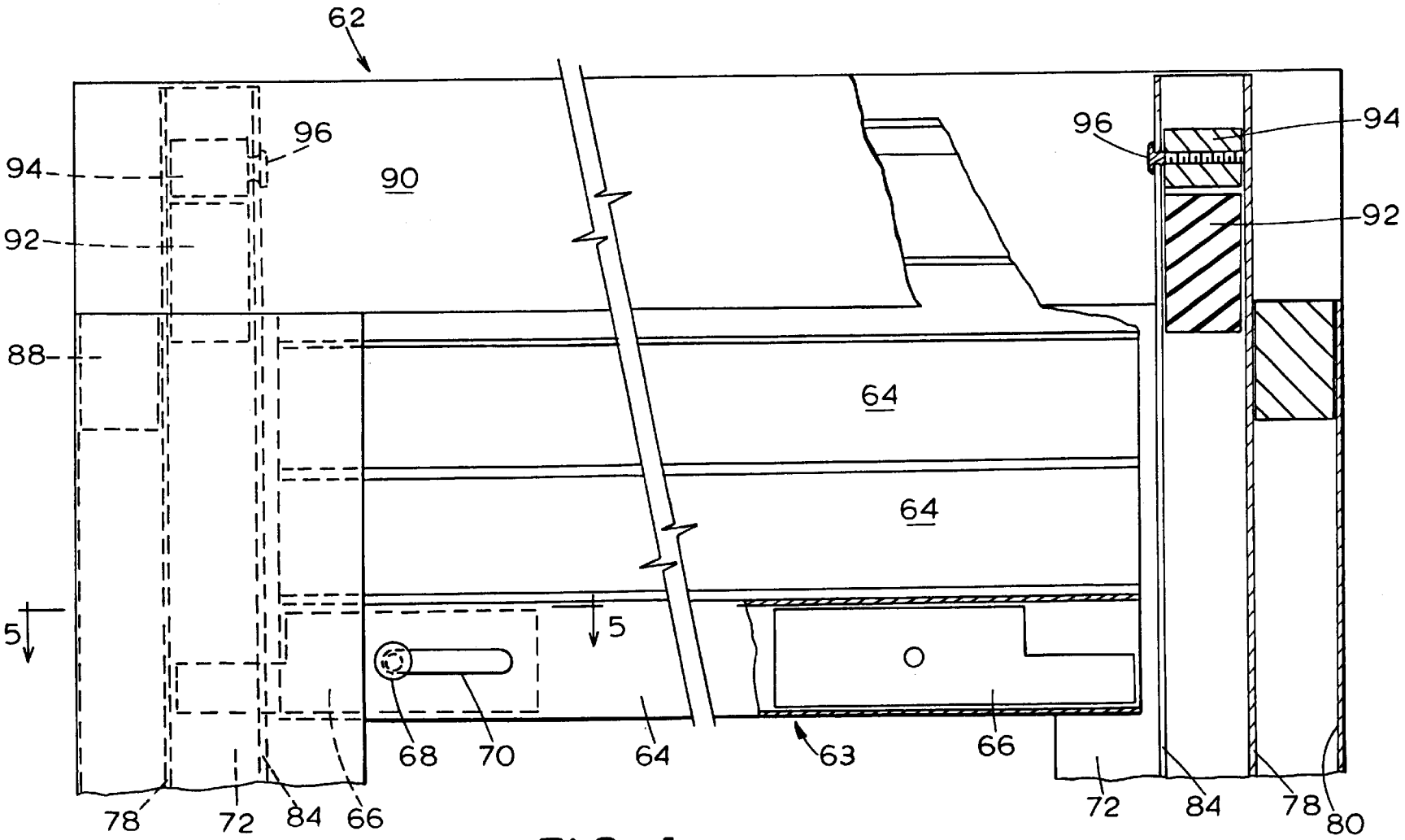
FIG. 4 is a partial cross-sectional front view of a portion of a shutter assembly implementing a stopping mechanism according to the present invention.

As previously discussed, a portion of the shutter 30 must remain outside the shutter housing and within the side tracks 40 when the shutter 30 is rolled up. Previously, the shutter 30 was stopped using a visible, external mechanism via a metal-to-metal impact of a part of the shutter 30, such as the handle 48 on the bottommost slat 46, and either a part of the housing or members extending inwardly from the side tracks 40. Repeated impacts of the components of the protective shutter 10 can cause damage the components and generally degrade the appearance of the protective shutter 10. An improved hidden mechanism for stopping the shutter 30 according to the present invention is illustrated in FIGS. 4 and 5.

The improved stopping mechanism according to the present invention utilizes retractable arms on the ends of one of the slats to engage rubber stops disposed within the side tracks proximate the housing. Referring to FIG. 4, which is a partial cross-section, a portion of a protective shutter 62 implementing the stopping mechanism is illustrated. The protective shutter 62 includes a rolling shutter 63 composed of a plurality of slats 64. The bottommost slat 64 has a pair of retractable arms 66 disposed therein at either end and slidable within the slat 64 between an extended position, as shown for the arm 66 on the left, and a retracted position, as shown for the arm 66 on the right. In the illustrated embodiment, the arms 66 are secured in the extended and retracted positions by set screws 68 that are slidable within slots 70 on the surface of the slat 64.

The protective shutters 62 further include side tracks 72 that are adapted to receive the extended arms 66 and allow the shutter 63 to be rolled up and unrolled. The structure of the side tracks 72 is illustrated in FIG. 5, which is a horizontal cross-section of the left side track 72. Each side track 72 has the same general configuration as the side tracks 40 described above, with a pair of side walls 74, 76, and end wall 78, and a structural support member 80. The side track 72 further includes a pair of fins 82, 84 that extend inwardly from the side walls 74, 76, respectively, and define a gap 86 wide enough to receive the extended arm 66. Configured in this way, the side tracks 72 provide three separate channels. The fins 82, 84 and portions of the side walls 74, 76 define a first channel adapted to receive the slats 64 when the shutter 63 is unrolled. The end wall 78 and the structural support member 80 define a second channel that receives a nipple 88 extending downwardly from the housing 90 when the protective shutter 62 is assembled, as shown in FIG. 4.

The stopping mechanism further includes a rubber stop 92 disposed within a third channel defined by the end wall 78, the fins 82, 84, and the portions of the side walls 74, 76 between the end wall 78 and the fins 82, 84. The rubber stop 92 is frictionally engaged by the walls 74, 76, 78 and fins 82, 84 with sufficient force to hold the stop 92 in place with the third channel against gravity, and is slidable with the third channel when an additional force is exerted to reposition the stop 92.

The shutter tracks 72 according to the present invention provide additional structural support for the housing 90 of the protective shutter 62. Because the first channel receives the shutter 63 and the second channel receives the nipple 88, the first and second channels terminate proximate the bottom of the housing 90. Conversely, the third channel extends upwardly into the housing 90 and terminates proximate the top of the housing 90. Arranged in this way, the rear of the housing 90 may be mounted directly to the side tracks 72. This arrangement provides a significant advantage over previous protective shutters wherein the nipples provided the only structural connection between the housing and the side tracks and were susceptible to cracking or breaking off under the weight of the housing.

The stopping mechanism further includes a positioning block 94 disposed within the third channel above the rubber stop 92. The positioning block 94 includes a set screw 96 that may be tightened to hold the block 94 in place in the third channel and untightened to allow the block 94 to slide up and down within the third channel. By sliding the block 94 up or down, the stopping point of the shutter 63 is adjusted to the desired height. In an alternative embodiment of the present invention, the block 94 may be omitted and rubber stop 92 may be held in place in the side track 72 by having the upper end of the stop 92 engage the top of the housing 90. In this embodiment, the stopping position of the shutter 63 may be adjusted using stops 92 of different lengths. In another alternative embodiment, the rubber stop 92 may be omitted so that the positioning block 94 alone is used to stop the shutter 63. Other alternative arrangements for positioning a stop member within the third channel of the side track 72 will be obvious those of ordinary skill in the art.

When the arms 66 are in the retracted position, each arm 66 is disposed within the slat 64. In this position, the stopping mechanism allows full travel of the shutter 63 within the side tracks 72 and into the housing 90. The arms 66 are generally stored in the retracted position during assembly, shipping, installation and maintenance of the protective shutter 62. The arms 66 are set to the extended position during normal use of the protective shutter 62. When the arms 66 are in the extended position, the end of each of the arms 66 is disposed within the gap 86 and the third channel formed by the walls 74, 76, 78 and fins 82, 84. When the shutter 63 is rolled up toward the housing 90, the arms 66 are engaged by the rubber stop 92, which is in turn engaged by the positioning block 94, to stop the shutter 63 and to retain the bottommost shutter 64 within the side track 72. By using the rubber stop 92 in the stopping mechanism, the arms 66 can repeatedly impact the rubber stop 92 without causing damage to the arms 66, the bottommost slat 64, or any other components of the protective shutter 62. Moreover, the metal-on-rubber impact of the arms 66 and the rubber stops 92 is significantly quieter than the impacts in previous stopping systems. However, as described in the alternative embodiment described above, the metal positioning blocks 94 may be used to engage the arms 66 directly.

Figure 6:
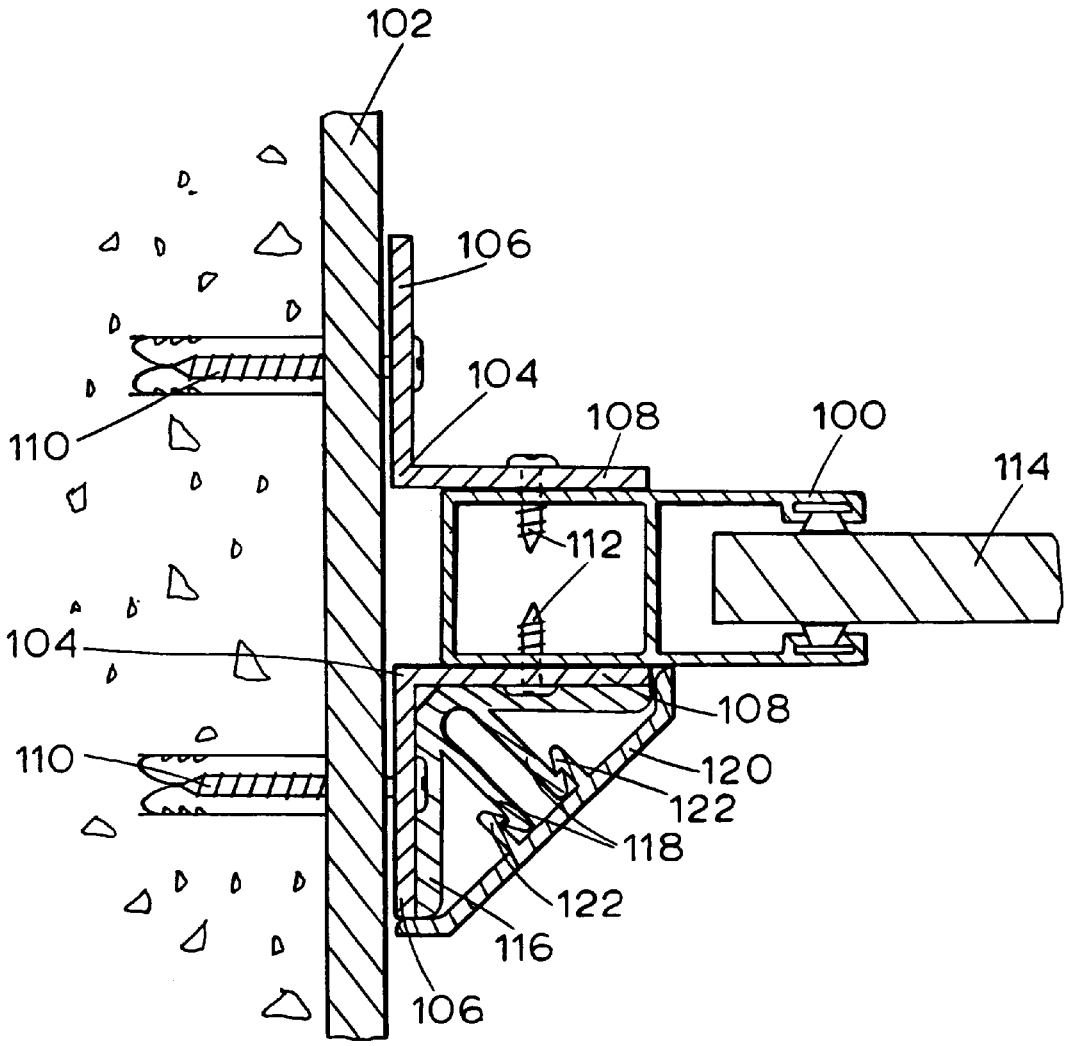
FIG. 6 is a cross-sectional top view of a portion of an angle mounted side track including a cover assembly according to the present invention.

As previously mentioned, an angle mount may be used in applications wherein a protective shutter is mounted between the walls or jambs that define an opening. FIG. 6 illustrates one example of an angle mount including an angle mount cover assembly according to another aspect of the present invention. In the illustrated angle mount, a side track 100 is mounted to a wall 102 using a pair of angle brackets 104 each having a first flange 106 and a second flange 108 oriented perpendicular with respect to the first flange 106. The first flanges 106 of the brackets 104 are mounted to the wall 102 by a plurality of fasteners 110 with the second flanges 108 defining a channel into which the side track 100 is inserted. The side track 100 is disposed between the second flanges 108 and fastened to the second flanges 108 by a plurality of fasteners 112. Once the angle mount is assembled, the side track 100 is ready to receive the slats 114 of the protective shutter.

In one aspect, the present invention includes a cover assembly adapted to hide the brackets 104 and fasteners 110, 112. The cover assembly includes a base 116 that is shaped to fit the contour of an angle bracket 104. The base 116 is fastened to the bracket 104 either with the same fasteners 110, 112 used to mount the bracket 104, with additional fasteners (not shown), or with an adhesive. The base 116 includes a first part of an attachment mechanism in the form of male prongs 118 extending outwardly away from the bracket 104. The cover assembly further includes a cover 120 dimensioned to cover the base 116 and the angle bracket 104 so that only the cover 120 and a portion of the side track 100 are visible. Although the cover 120 shown in FIG. 6 is generally flat, the cover 120 could have any other profile that is aesthetically desirable for a given application, such as square, rounded and the like, that do not require penetration of the fastened components.

The cover 120 includes a second portion of the attachment mechanism in the form of female prongs 122 extending inwardly toward the bracket 104. The cover 120 is installed onto the base 116 either by sliding the female prongs 122 onto the male prongs 118, or by snapping the female prongs 122 onto the male prongs 118 by applying a compressive force. Other mechanisms for attaching the cover assembly to a bracket 104 and for assembling the base 116 and the cover 120 will be obvious to those of ordinary skill in the art and are contemplated by the inventor as having use with the present invention. For example, the brackets 104 could be fabricated with the male prongs 118 extending therefrom and with the covers 120 attached directly to the brackets 104, thereby eliminating the need for a separate base 116. Alternatively, the base 116 and cover 120 could be fabricated as a single unit and mounted on the bracket 104 using an adhesive.

Figure 7:
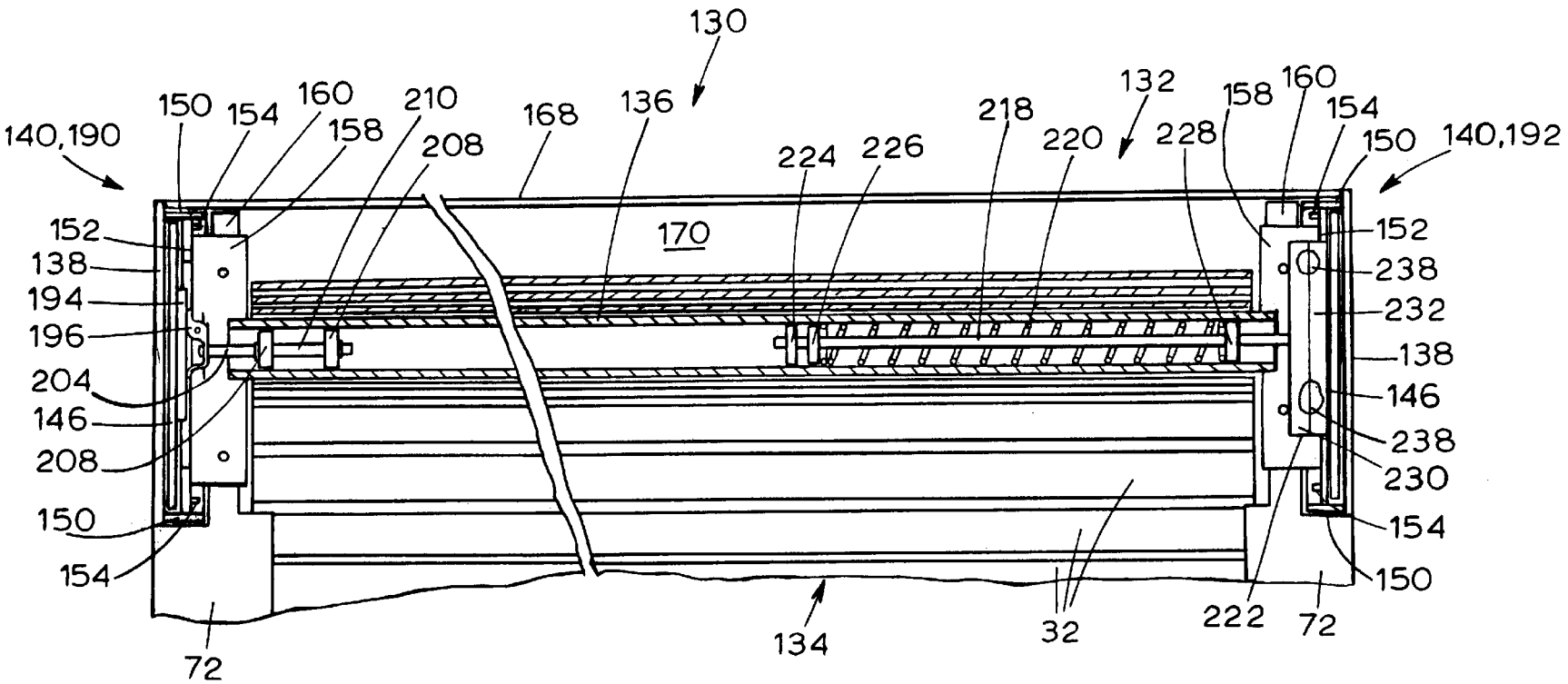
FIG. 7 is a partial cross-sectional front view of a modular housing assembly according to the present invention with the front wall removed.

As previously discussed, it is desirable to have a modular shutter assembly that is structurally stronger than previously known shutter assemblies and cheaper and safer to ship and install. FIG. 7 illustrates a portion of a shutter assembly 130 implementing a modular design according to the present invention. A shutter housing 132 is shown with the front wall removed and the shutter 134 and shutter support member 136 shown in partial section. The shutter support member 136 and shutter 134 are mounted within the shutter housing 132 between the side walls 138. The side walls 138 are defined by a pair of modular side assemblies 140 according to one aspect of the present invention and adapted for modular assembly of the shutter assembly 130.

Figure 8:
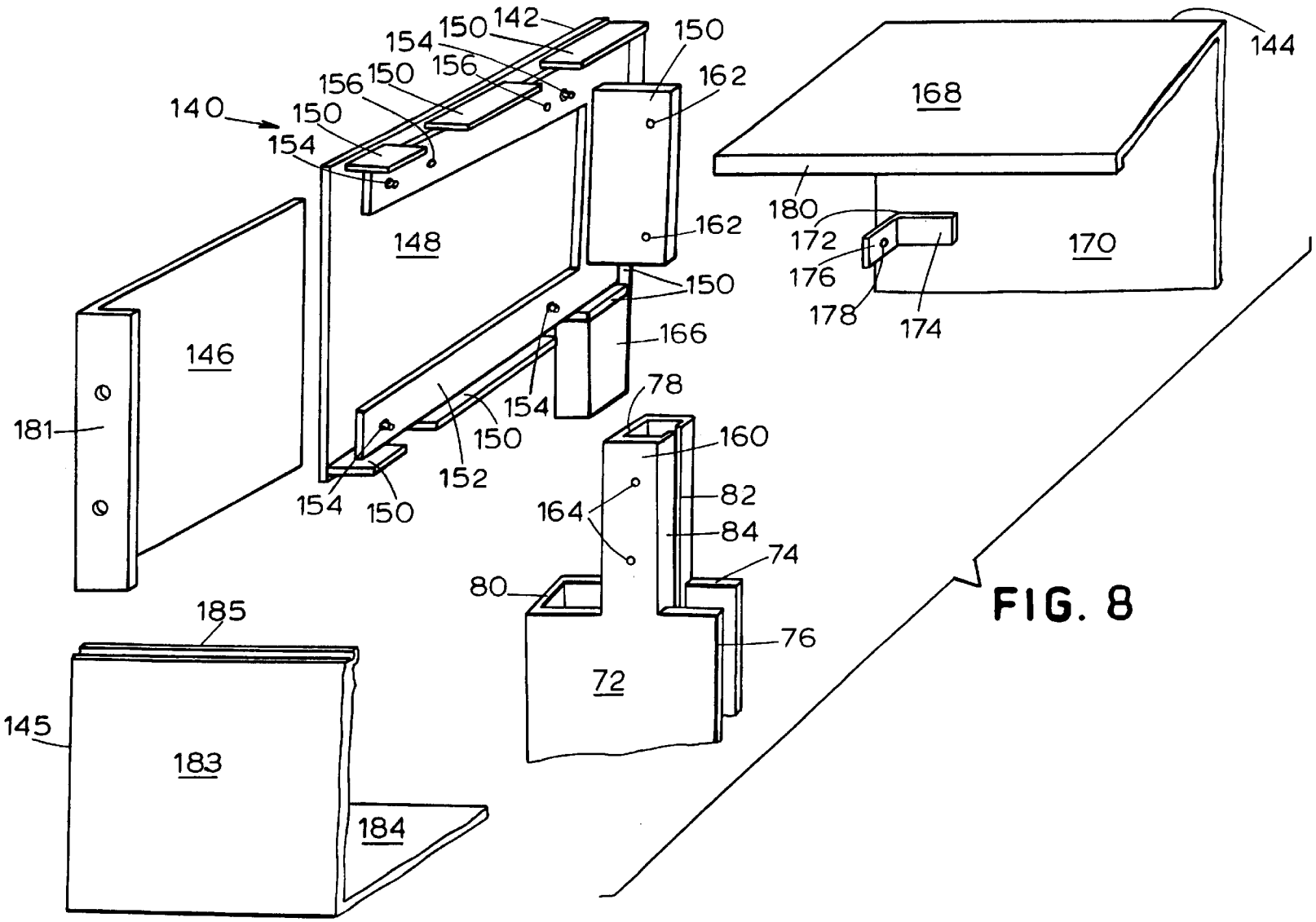
FIG. 8 is an exploded isometric view of a modular side assembly according to the present invention.

Referring to FIG. 8, a modular side assembly 140 of the shutter assembly 130 is illustrated with the component parts separated for clarity. Each modular side assembly 140 consists of an end cap 142, a top and rear housing portion 144, a front and bottom housing portion 145, a side track 72 as shown and described in FIGS. 4 and 5, and a shutter mounting plate 146. The end cap 142 includes an end plate 148 that forms the end wall 138 of the shutter housing 132. The end cap 142 further includes housing support walls 150 extending inwardly from the end plate 148 proximate the top, rear and bottom edges of the end plate 148. Each edge has a plurality of housing support walls 150 that are spaced on the edges to allow insertion of connective members on the housing portion 144 as will be described below.

The end cap 142 further includes a shutter and housing mounting bracket 152 connected to and extending inwardly toward the center of the end plate 148 from the housing support walls 150. The mounting bracket 152 is oriented generally parallel to the end plate 148 and offset from the end plate 148 by a distance sufficient to create a channel for insertion of the shutter mounting plate 146 between the end plate 148 and the mounting bracket 152. The mounting bracket 152 includes one or more set screws 154 disposed on the top and bottom portions of the mounting bracket 152 to secure the shutter mounting plate 146 in place when the plate 146 is inserted between the end plate 142 and the mounting bracket 152. The mounting bracket 152 further includes hole 156 on the top portion and the rear portion (not shown) that are located within the spaces between the housing support walls 150 so that the holes 156 will align with the connection members on the housing portion 144.

The end cap 142 further includes a side track mounting bracket 158 is connected to and extends inwardly from the rear portion of the mounting bracket 152. The mounting bracket 158 is spaced from the rear housing support walls 150 by a distance sufficient to allow insertion therebetween of an upward extension 160 of the third channel of the side track 72. The mounting bracket 158 has holes 162 positioned to align with holes 164 on the upward extension 160 for insertion of fasteners (not shown) that secure the side tracks 72 to the end cap 142. The end cap 142 further includes a nipple 166 extending downwardly from the bottom rear corner of the end cap 142. The components of the end cap 142 may be fabricated separately and welded or otherwise connected to form the end cap 142. Alternatively, some or all of the components of the end cap 142 may be integrally formed from a single casting operation.

The top and rear housing portion 144 defines the top and rear walls 168, 170 of the shutter housing 132. The top wall 168 and rear wall 170 include connection members 172 that are used to secure the housing portion 144 to the end cap 142. Each connection member 172 includes a wall mount portion 174 and an end cap mount portion 176 oriented approximately perpendicular to the wall mount portion 174. The wall mount portion 174 is secured to the associated wall 168, 170 by an adhesive. The end cap mount portion 176 has a hole 178 that will align with a corresponding hole 156 in the mounting bracket 152 for reception of a fastener (not shown) to secure the housing portion 144 to the end cap 142. This arrangement eliminates the necessity in previous shutter assemblies of drilling through the exterior of the shutter housing 132 to attach the housing portion 144 to the end cap 142. Alternatively, the mount portion 176 and bracket 152 may be fastened via other known fastening methods, such as adhesives, welding and the like, that do not require penetration of the fastened components.

The connection members 172 are positioned on the top and rear walls 168, 170 to align with the spaces between housing support walls 150 on the top and rear edges of the end plate 148. The connection members 172 are spaced from the outer edges of the top and rear walls 168, 170 by a distance such that the end cap mount portions 176 are flush against the mounting bracket 152 and the edges of the top and rear walls 168, 170 are flush against the inside surface of the end plate 148 when the housing is assembled. The housing portion 144 further includes a front lip 180 that extends downwardly along the front edge of the top wall 168. The front lip 180 is configured to receive a top edge of the front and bottom housing portion 145 in order to seal the front of the shutter housing 132.

In previously known shutter systems, and end caps include support walls along the front edge. The front wall of the housing is connected to the support wall to secure the front wall and hold the outer surface of the front wall flush with the front edge of the end cap. In the modular side assembly 140 according to the present invention, a front support wall is still necessary, but the wall must be removable to allow insertion of the shutter mounting plate 146 into the channel between the end wall 148 and mounting bracket 152.

FIG. 8 shows one alternative arrangement for implementing removable front support walls in a modular side assembly 140. In this embodiment, the front edge of the end wall 148 has no support walls and presents a clear opening for insertion of the mounting plate 146. The mounting plate 146 includes a front support wall 181 integrally formed along the front edge. When the mounting plate 146 is inserted, the front support wall 181 abuts the front edges of the mounting bracket 152. The front support wall 181 includes holes 182 that will receive fasteners (not shown) mounted on the inside surface of a front wall 183 of the front and bottom housing portion 145. The fasteners, which may be similar to those used to secure the interior panels on car doors, snap into the holes 182 to hold the front wall 183 flush with the front edge of the end wall 148 when the housing is assembled, and unsnapped to detach the front wall 183 when the front and bottom housing portion 145 is removed to allow access to the interior of the housing 132. The bottom wall 184 is similarly demountably attached to the support walls 150 along the bottom edge of the end plate 148. The front wall 183 includes a top edge 185 that is inserted into the front lip 180 of the top wall 168 to seal the front of the shutter housing 132.

Figure 8A:
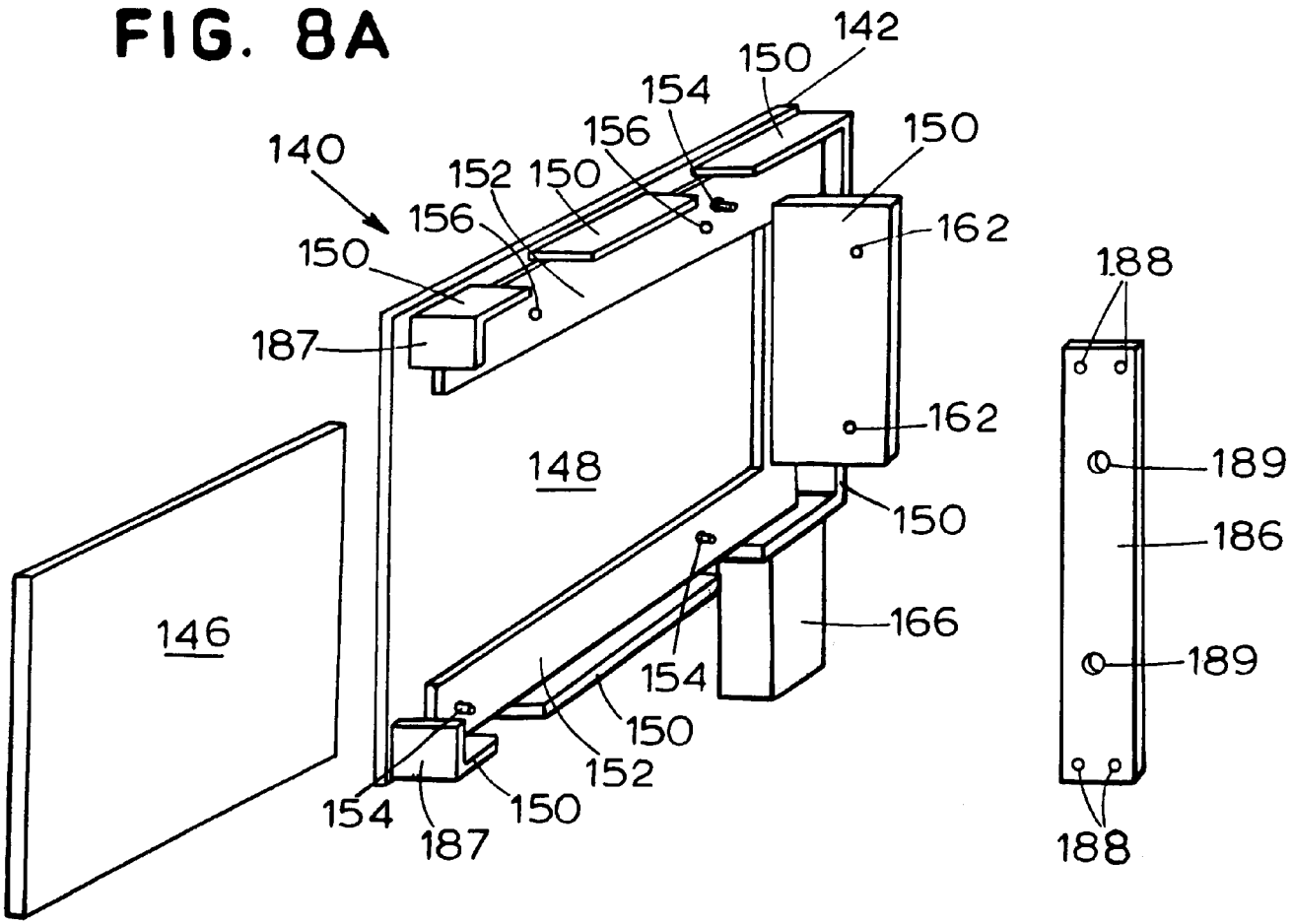
FIG. 8*a* is an exploded isometric view of the modular side assembly of FIG. 8 implementing a first alternative removable front wall.

Another alternative arrangement for implementing a removable front wall is shown in FIG. 8*a*. In this alternative, a front support wall 186 is provided as a separate detachable component. In this embodiment, the end cap 142 includes a pair of retention walls 187, which may be integrally connected to the adjoining support walls 150, mounted on the top and bottom of the front edge of the end wall 148. The retention walls 187 are spaced from the front edges of the mounting bracket 152 so that the front wall 186 may be inserted therebetween. The front support wall 186 includes integrally formed raised portions 188 that bear upon the retention walls 187 to form a snug fit and to retain the front support wall 186 between the retention walls 188 and mounting bracket 152. Other mechanisms for demountably attaching the front support wall 186 to the retention walls 187 will be obvious to those of ordinary skill in the art. During assembly, the mounting plate 146 is inserted and the front support wall 186 is attached between the retention walls 187 and mounting bracket 150. The front and bottom housing portion 145 is attached in a similar manner as previously described with the fasteners on the front wall 183 snapped into holes 189 on the front support wall 186.

Figure 8B:
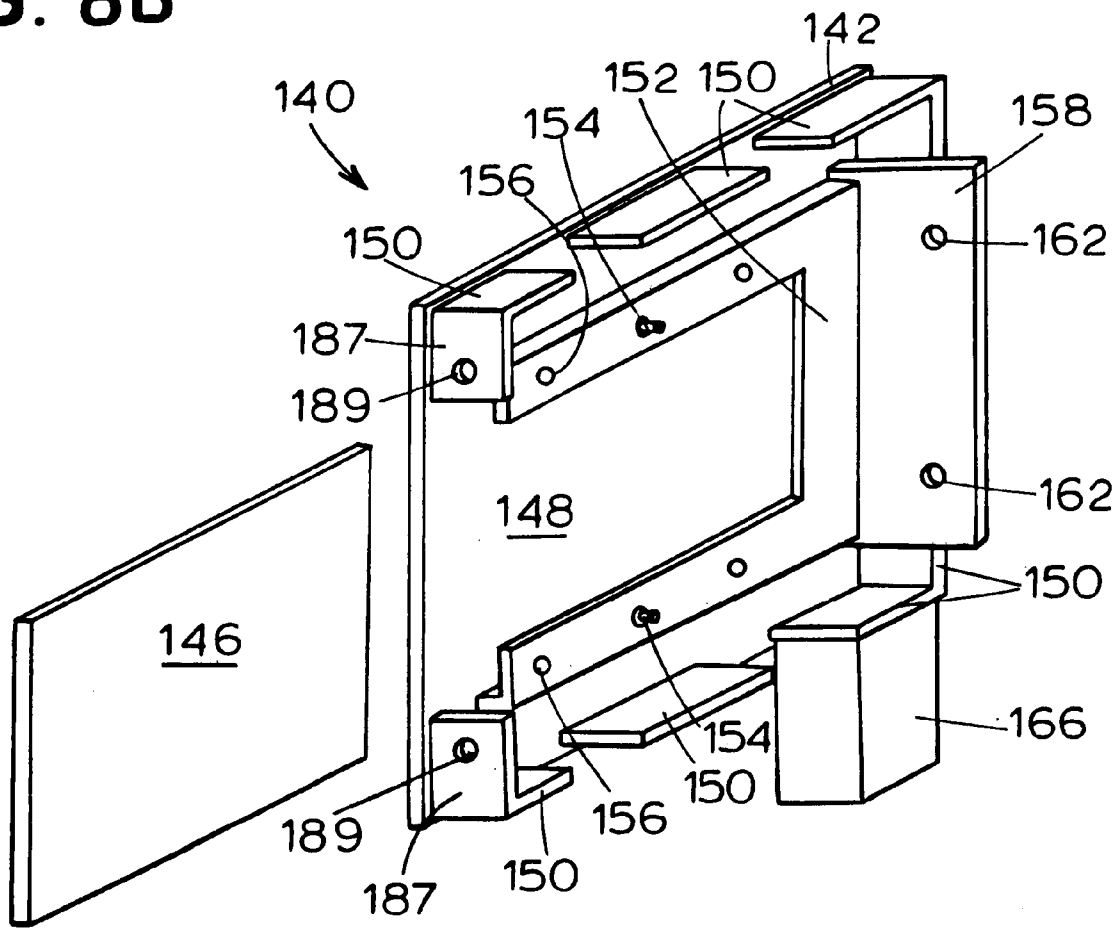
FIG. 8*b* is an exploded isometric view of the modular side assembly of FIG. 8 implementing a second alternative removable front wall.

Yet another alternative arrangement for allowing insertion of the mounting plate 146 is shown in FIG. 8*b*. In this alternative, the retention walls 187 extend inwardly from the top and bottom edges of the end wall 148 such that holes 189 in the retention walls 187 are positioned to receive the fasteners on the front wall 183. The mounting bracket 152 is mounted directly to the end wall 148 and the mounting plage 146 is dimensioned to fit through the opening between the retention walls 187 for insertion into the channel between the end wall 148 and mounting bracket 152. Once the plate 146 is inserted, the front and bottom housing portion 145 is demountably attached as described above.

Referring back to FIG. 8 to describe the assembly of the modular side assembly 140, the end cap 142 is first secured to the top and rear housing portion 144. The end cap mount portions 176 of the connection members 172 are inserted into the associated spaces in the housing support walls 150 until the mount portions 176 abut the housing support walls 150 and the edges of the top and rear walls 168, 170 abut the interior surface of the end plate 148. The housing support walls 150 are offset from the edges of the end plate 148 by a distance approximately equal to the thickness of the top and rear walls 168, 170. The end cap 142 and housing portion 114 mate such that the outer surfaces of the walls 168, 170 are approximately flush with the top and rear edges of the end plate 148 and the inner surfaces of the walls 168, 170 are flush against the top and rear housing support walls 120. The housing portion 144 is secured to the end cap 142 by installing fasteners in the aligned holes 156, 178.

After the housing portion 144 is secured to the end cap 142, the side track 72 is secured to the end cap 142. The nipple 166 of the end cap 142 is inserted into the second channel of the side track 72 as the upward extension 160 of the third channel is inserted into the space between the side track mounting bracket 158 and the rear wall 170. The nipple 166 is inserted into the second channel until the side track 72 abuts the bottom of the end cap 142. At this point, the holes 162 in the mounting bracket 158 align with the holes 164 in the upward extension 160 of the third channel. The side tracks 72 are rigidly secured to the end cap 142 by fasteners inserted into the holes 162, 164.

Once the end caps 142, housing portion 144, and side tracks 72 are assembled on both sides of the shutter assembly 130, the assembly 130 is erected over the opening by mounting the side tracks 72 to the walls that define the opening. With the side tracks 72 and shutter housing erected, the shutter 134 and shutter support member 136 can be installed in the shutter housing. The mounting hardware at either end of the shutter support member 136 is rigidly fastened to the shutter mounting plates 146 by nuts and bolts, rivets, welds, adhesives, or other similar fastening method. Once connected, the shutter 134, shutter support member 136 and mounting plates 146 form a cassette that is installed in the assembled housing by sliding the mounting plates 146 into the channels in the end caps 142 formed by the end plates 148 and the mounting brackets 152. The mounting plates 146 are secured in the channels by tightening the set screws 154 in the mounting brackets 152. Once the cassette is installed, the shutter housing is closed by attaching the front and bottom housing portion 145 to the end caps 142 in the manner previously described.

Figure 21:
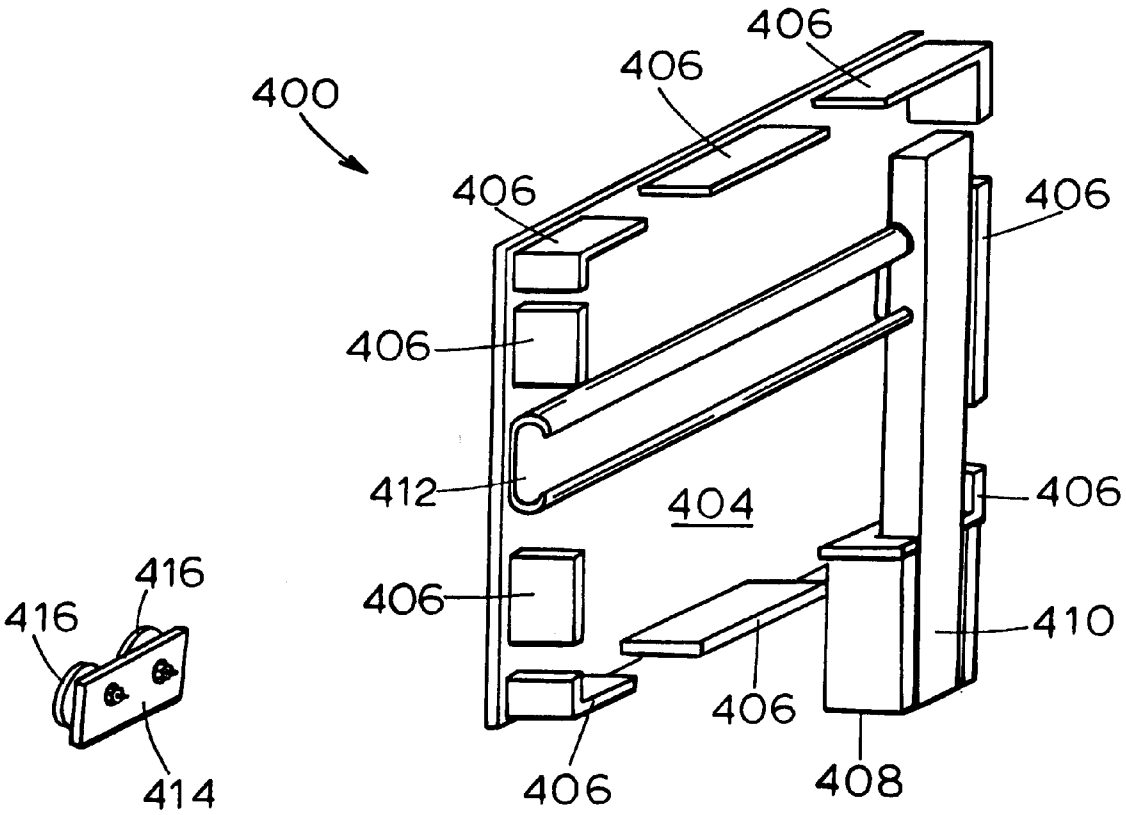
FIG. 21 is an exploded isometric view of an alternative embodiment of a modular side assembly according to the present invention.

FIG. 21 illustrates an alternative embodiment of a modular side assembly 400. The assembly 400 includes an end cap 402 having an end plate 404 and a plurality of housing support walls 406 extending inwardly from the surface of the end plate 404 and spaced about the front, rear, top, and bottom edges of the end plate 404. The end cap 402 further includes a nipple 408 extending downwardly from the bottom rear corner of the end plate 404. A support member 410 is included in the assembly to provide additional support for the weight of the shutter curtain. The bottom portion of the support member 410 is nested within the nipple 410, and the support member 410 extends upwardly through the bottom rear support wall 406 and along the rear edge of the end plate 404. When the weight of the shutter curtain is added to the shutter housing, the support member engages the rear housing support wall 406 to maintain the housing in the upright position.

The end cap 402 further includes a track 412 attached to the end plate 404 and running horizontally proximate the center of the end plate 404. The track 412 may be attached to the end plate 404 with bolts, adhesive, or any other well know fastening method, including integrally forming the end plate 404, support walls 406, nipple 408, and track 412 as a single casting. The track 412 is vertically disposed on the end plate 404 within a gap between the front housing support walls 150 so that access to the front opening of the track 412 is unrestricted.

The assembly 400 further includes a shutter mounting plate 414 to which a pair of rollers 416 are mounted. The rollers 416 are mounted side-by-side with their rotational axes parallel to one another and perpendicular to the surface of the mounting plate 416. The track 412 and the rollers 416 are dimensioned so that the rollers 416 fit into the track 412 and the track 412 wraps around the rollers 416 to prevent the rollers 416 from being pulled out of the track 412 in a direction perpendicular to the surface of the end plate 404.

The shutter 134 and shutter support member 136 are installed in a similar manner as described above. Mounting plates 414 are fastened to either end of the shutter support member 136 to form a cassette. Once the shutter support member 136 is connected to the mounting plates 414, the rollers 416 are inserted into the tracks 412. After the cassette is installed, the shutter housing is closed by attaching the front and bottom housing portion 145 to the end cap 402.

Figure 19:
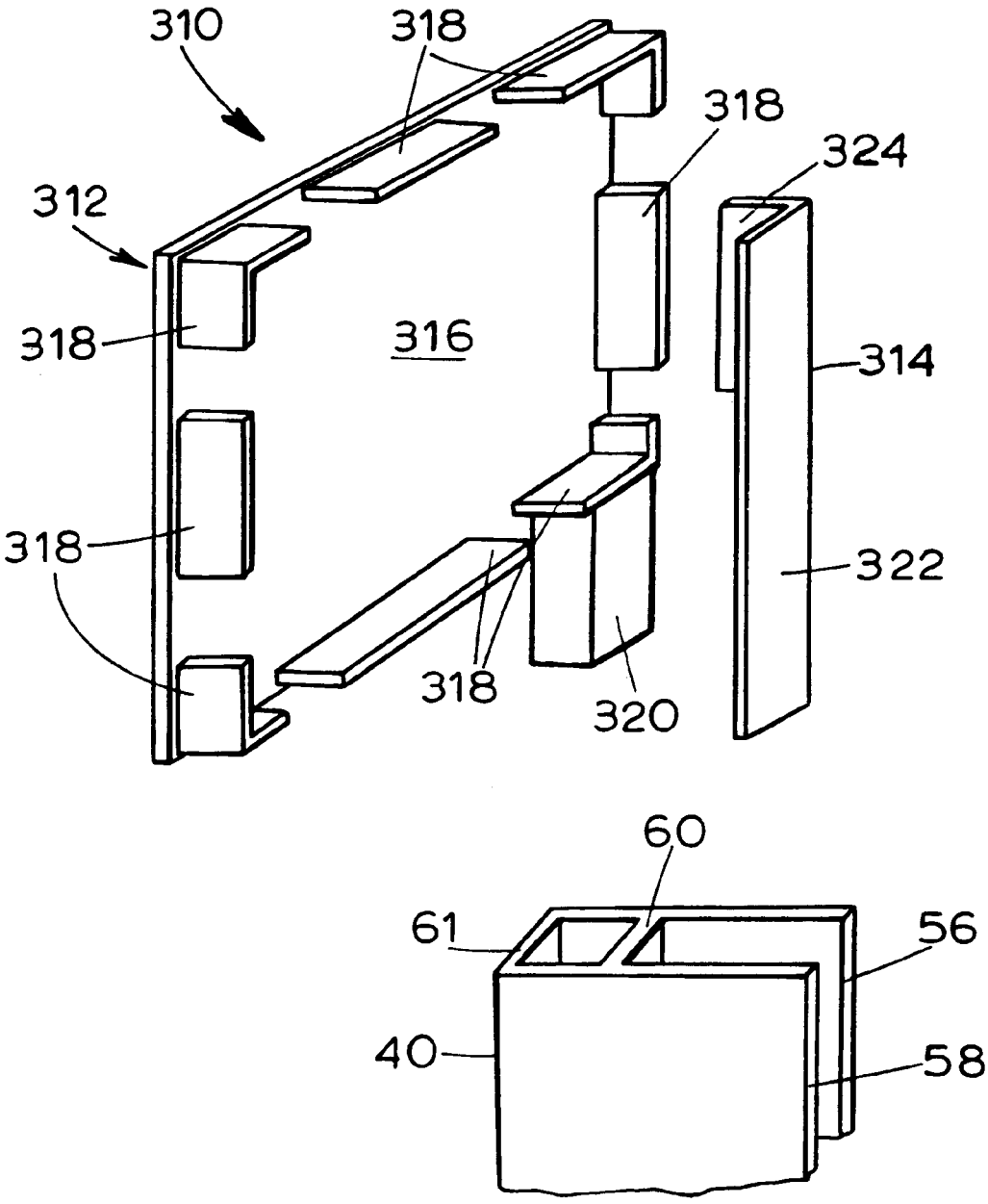
FIG. 19 is an exploded isometric view of an alternative side assembly according to the present invention.
Figure 20:
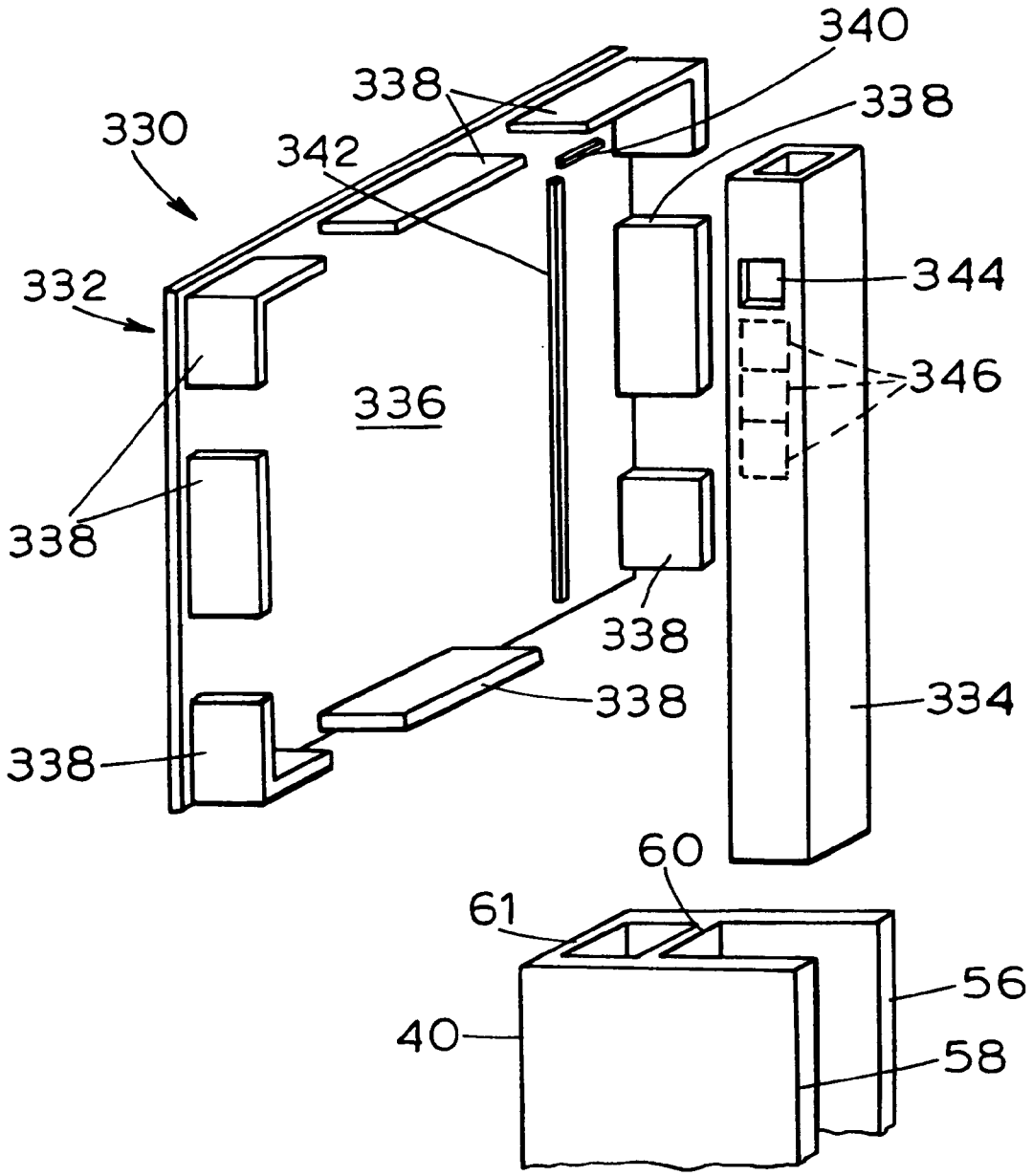
FIG. 20 is an exploded isometric view of another alternative side assembly according to the present invention.

The housing 132 may also be reinforced in installations using previously known side tracks 40. FIGS. 19 and 20 illustrate alternative side assemblies that provide increased structural support for the shutter housing through the addition of a housing support member. Referring to FIG. 19, a side assembly 310 is illustrated with the component parts separated for clarity. Each side assembly 310 consists of an end cap 312, a top and rear housing portion as shown and described in FIG. 8, a side track 40 as shown and described in FIG. 3, and a housing support member 314.

The end cap 312 includes an end plate 316 that forms the end wall 138 of the shutter housing 132. The end cap 312 further includes housing support walls 318 extending inwardly from the end plate 316, proximate the top, rear, bottom and front edges of the end plate 316. Each edge has a plurality of housing support walls 318 that are spaced on the edges to allow insertion of connective members on the housing portion 144 as previously described. Alternatively, the end cap 312 may be configured for modular assembly of a shutter cassette by removing the housing support walls 318 along the front edge of the end plate 316 and connecting a housing mounting bracket to the remaining housing support walls 318 as previously described in relation to FIG. 8. In either alternative, the end cap 312 further includes a nipple 320 extending downwardly from the bottom rear corner housing support walls 318.

The housing support member 314 includes a side portion 322 oriented parallel to the end plate 316 of the end cap 312, and a back portion 324 oriented parallel to the housing support walls 318. The housing support member 314 is attached to the end cap 312 by fastening the back portion 324 to the rear housing support wall 318. The back portion 324 may be fastened to the housing support wall 318 using screws, bolts, adhesive, welds, or any other connection method known in the art. When connected to the end cap 312, the side portion 322 of the housing support member 314 extends below the bottom edge of the end plate 316 and is disposed adjacent the nipple 320.

The end cap 312 and housing support member 314 are connected to the side track 40 by inserting the nipple 320 into the channel formed by the end wall 60 and the structural support member 61. The downwardly extending side portion 322 of the housing support member 314 is also inserted into the side track 40 and may be disposed either on the same side of the end wall 60 as the nipple 320 or on the opposite side of the end wall 60 and within the channel formed by the side walls 56, 58 and the end wall 60. The weight of the shutter tends to pivot the housing about the point where the nipple 320 is connected to the housing support wall 318. The weight of the shutter causes the rear housing support wall 318 to bear upon the back portion 324 of the housing support member 314. The weight of the shutter and housing is transferred through the side portion 322 to the side track 40, thereby relieving the nipple 320 of the stress caused by supporting the weight of the shutter.

FIG. 20 illustrates another alternative side assembly 330 including an end cap 332, housing support member 334, and side track 40. The components of the side assembly 330 are separated in FIG. 20 for the sake of clarity. The end cap 332 includes an end plate 336 that forms the end wall 138 of the shutter housing 132. The end cap 332 further includes housing support walls 338 extending inwardly from the end plate 336 proximate the top, rear, bottom and front edges of the end plate 336. Each edge has a plurality of housing support walls 338 that are spaced on the edges to allow insertion of connective members on the housing portion as previously described. Alternatively, the end cap 332 may be configured for modular assembly of a shutter cassette by removing the housing support walls 338 along the front edge of the end plate 336 and connecting a housing mounting bracket to the remaining housing support walls 338 as described and illustrated in relation to FIG. 8.

The end cap 338 is adapted for attachment of the housing support member 334 by omitting the nipple and the bottom rear housing support wall 338 of the previously described end caps. The end cap 332 further includes an upper locator 340 mounted to the end plate 336 proximate the top rear corner of the end cap 332. The end cap 332 further includes a side locator 342 mounted to the end plate 336. Side locator 342 runs parallel to the rear edge of the end plate 336 and is spaced from the rear housing support walls 338 by a distance approximately equal to the thickness of the housing support member 334.

The side assembly 330 is assembled by inserting the housing support member 334 between the side locator 342 and the rear housing support wall 338 with the top edge of the housing support member 334 abutting the upper locator 340. The housing support member 334 may be connected to either the end plate 336, the rear housing support wall 338, or both by any common fastening method. The housing support member 334 extends below the bottom edge of the end plate 336. The bottom extending portion of the housing support member 334 is inserted into the channel formed by the end wall 60 and the structural support member 61 until the bottom edge of the end plate 336 engages the top edge of the side track 40. The housing support member 334 is then secured to the frame of the opening directly along with the side track 40.

The side assembly 330 provides additional structural support for the shutter housing in a similar manner as the side assembly 310 of FIG. 19. The weight of the shutter causes the rear housing support wall 338 to bear against the upper portion of the housing support member 334. The weight of the shutter is subsequently transferred to the side track 40 as the lower portion of the housing support member 334 bears against the structural support member 61.

Although the housing support member 334 is illustrated with a square or rectangular cross section, the housing support member 334 may have other hollow configurations, such as a U-shaped channel or an L-shaped angle. These configurations provide the necessary support for the shutter while providing an open channel for wiring for electric motors disposed within the shutter housing. Additionally, the configuration of the shutter assembly may require either wiring or a tension control strap to pass through the rear of the shutter housing. In these configurations, openings 344 are provided in the front and rear surfaces of the housing support member 334. Alternatively, the walls of the housing support member may include perforations 346 that allow an installer to punch out holes in the housing support member 334 in the positions required at the time that the shutter assembly is installed.

Referring back to FIG. 7, the shutter 134 and shutter support member 136 are connected at either end to the mounting plates 146. In order to accommodate shutters having different widths, the attachment hardware mounting either end of the shutter 134 and shutter support member 136 to the shutter housing is installed and operates independently. Therefore, a mounting assembly 190 on the left side of the shutter assembly 130 in FIG. 7 is independent from a mounting assembly 192 on the right side.

Figure 9:
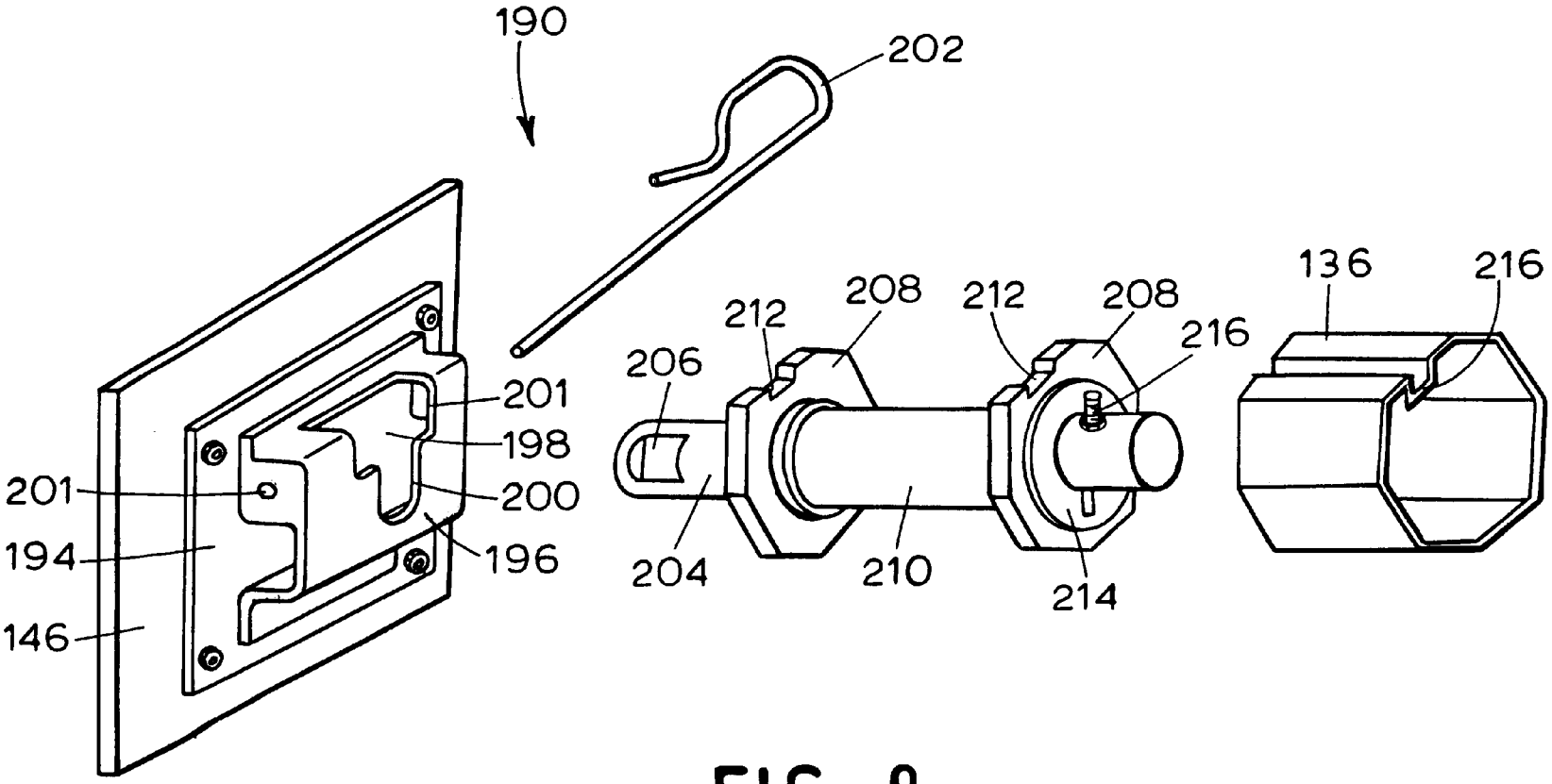
FIG. 9 is an exploded isometric view of a mounting assembly for the modular shutter housing of FIG. 7.

The mounting assembly 190 is shown in greater detail in FIG. 9, which is an exploded view for the sake of clarity. The assembly 190 includes a plate 194 having a bracket 196 mounted thereon and connected to the mounting plate 146 by bolts as shown or by other connection methods such as welds, adhesives and the like. The bracket 196 is raised from the surface of the plate 194 and has a keyway 198 with an upper wide portion 199 and a relatively narrower lower portion 200. The bracket 196 has a pair of holes 201 on either side that will receive a cotter pin 202 to secure the shutter 134 and shutter support member 136 to the shutter housing in a manner that described more fully below.

The mounting assembly 190 further includes an end shaft 204 that is inserted into the open end of the shutter support member 136. The end shaft is cylindrical and has a pair of grooves 206 disposed on either side proximate one end of the end shaft 204. A pair of shaft supports 208 are disposed on the other end of the end shaft 204 and separated by a sleeve 210. Each shaft support 208 is generally octagonal-shaped and has a notch 212 in the center of one of the edges. The shaft supports 208 are rotatable about the end shaft 204 and may or may not require bearings for easier rotation in applications with larger, heavier shutter curtains. The shaft supports 208 are secured along the end shaft 204 by washers 214 and pins 216 disposed on the opposite side of each shaft support 208 from the sleeve 210.

The shutter support member 136 has a generally octagonal cross section with an opening slightly larger than the shaft supports 208. The support member 136 has a key surface 217 disposed on one of the sides that extends inwardly and runs the entire length of the support member 136. The end shaft 204 is inserted into the shutter support member 136 with the grooves 206 extending beyond the end of the support member 136 and the notches 212 of the shaft supports 208 aligning with the key surface 217. Once inserted, the shaft supports 208 mate and rotate with the shutter support member 136. The two shaft supports 208 substantially axially align the end shaft 204 with the shutter support member 136. The exposed portion of the end shaft 204 is inserted into the wide portion 199 of the keyway 198 in the bracket 196. The narrow portion 200 of the keyway 198 is slightly wider than the thickness of the end shaft 204 between the grooves 206 and narrower than the outer diameter of the end shaft 204. The grooved portion of the end shaft 204 slides down into the narrow portion 200 of the keyway 198 and the sides of the keyway 198 engage the grooves 206 to prevent the end shaft 204 from rotating along with the shutter support member 136. The cotter pin 202 is inserted through the holes 201 to lock the end shaft 204 in place in the keyway 198.

As previously discussed, roll-up partition assemblies incorporate torsion springs to assist in lifting and rolling the shutters. Referring back to FIG. 7, the right side mounting assembly 192 includes a torsion spring assembly that facilitates ease of movement of the shutter 134 from the unrolled position to the rolled position. The torsion spring assembly is a self-contained, modular unit having a rod 218 surrounded by a coiled torsion spring 220 disposed within the shutter support member 136. The rod 218 is demountably, rigidly fixed to the mounting assembly 192 via a tension adjustment mechanism 222 in a manner that will be discussed in detail below. A rod support 224 is mounted on the rod 218 at the end distal to the tension adjustment mechanism 222. The rod support 224, which is similar to the shaft supports 208, has an octagonal shape and a notch along one of the edges that aligns with key surface 217 of the shutter support member 136. The rod support 226 mates with interior surface of the shutter support member 136 and is rotatable about the rod 218 to allow the support member 136 to rotate relative to the rod 218.

A spring plate 226 is rigidly mounted to the rod 218 and is disposed between the rod support 224 and the torsion spring 220. The outer diameter of the spring plate 226 is small enough to allow the shutter support member 136 to rotate relative to the rod 218 without engaging the outer surface of the spring plate 226. The spring plate 226 is rigidly connected to one end of the torsion spring 220 to prevent rotation of the end of the torsion spring 220 relative to the rod 218.

The counterbalancing mechanism further includes a spring drive 228 mounted on the end of the rod 218 proximate the tension adjustment mechanism 222 and adjacent the end of the torsion spring 220 opposite the spring plate 226. The spring drive 228 is similar to the rod support 224 with an octagonal shape and a notch along one of the edges that aligns with key surface 216 of the shutter support member 136. The spring drive 228 mates with interior surface of the shutter support member 136 and is rotatable about the rod 218 to allow the support member 136 to rotate relative to the rod 218. The proximate end of the torsion spring 220 is coupled to the spring drive 228 and rotates with the shutter support member 136 relative to the rod 218. When the shutter is unrolled, the torsion spring 220 is wound tighter as the end connected to the spring drive 228 rotates relative to the end connected to the spring plate 226, thereby providing additional torque to assist in lifting and rolling the shutter 134 onto the shutter support member 136.

As previously mentioned, the rod 218 of the torsion spring assembly is connected to the improved tension adjustment mechanism 222 according to the present invention. The rod 218, spring 220, rod support 224, spring plate 226 and spring drive 228 form a single modular unit that is inserted into one end of the shutter support member 136. The rod 218 is demountably coupled to the center of the tension adjustment mechanism 222 and secured thereto by a set screw or other quick-release coupler. If maintenance is required, such as if the spring 220 breaks or fatigues, the assembly is easily disconnected from the tension adjustment mechanism 222, removed from the support member 136, and replaced with a new assembly.

Figure 10:
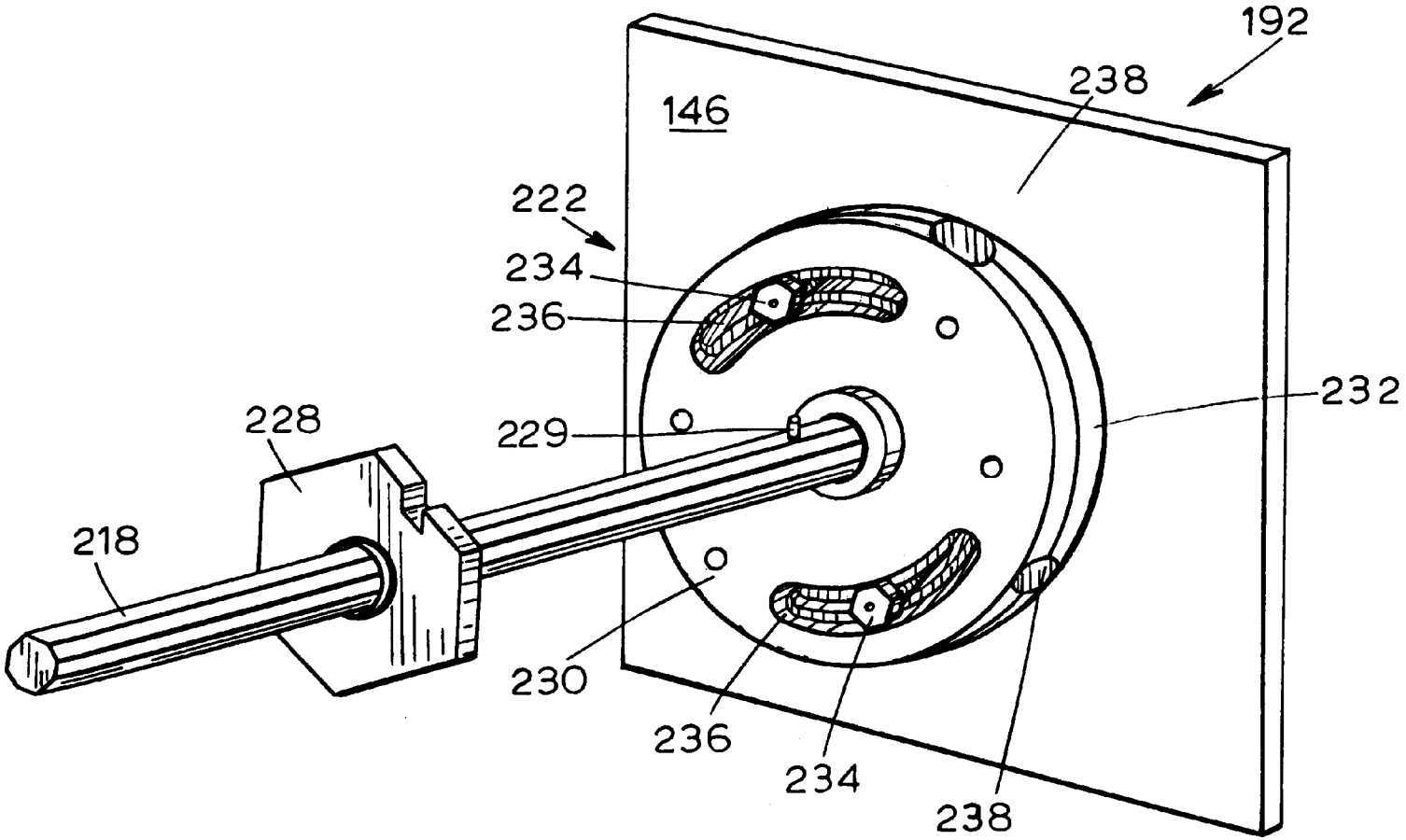
FIG. 10 is an isometric view of a mounting assembly for the modular shutter housing of FIG. 7 including a tension adjustment mechanism according to the present invention.

One embodiment of the tension adjustment mechanism 222 is shown in FIG. 10. The tension adjustment mechanism 222 is composed of a disk-shaped housing formed by a front plate 230 that mates with a back plate 232, with the rod 218 extending outwardly from an opening in the center of the front plate 230. The front and back plates 230, 232 enclose gearing to which the rod 218 is connected and that is discussed in greater detail below. The rod 218 may be permanently mounted to the gearing or, for flexibility in assembly and maintenance, may be demountably connected to the gearing. The tension adjustment mechanism 222 is mounted to the support plate 146 by a pair of bolts 234 passing through arc-shaped channels 236 in the front and back plates 230, 232. A pair of access openings 238 are located on the outer edge of the tension adjustment mechanism 222 and are adapted to receive tools, such as ratchets and drill bits, that are operated to turn the gearing.

Figure 11:
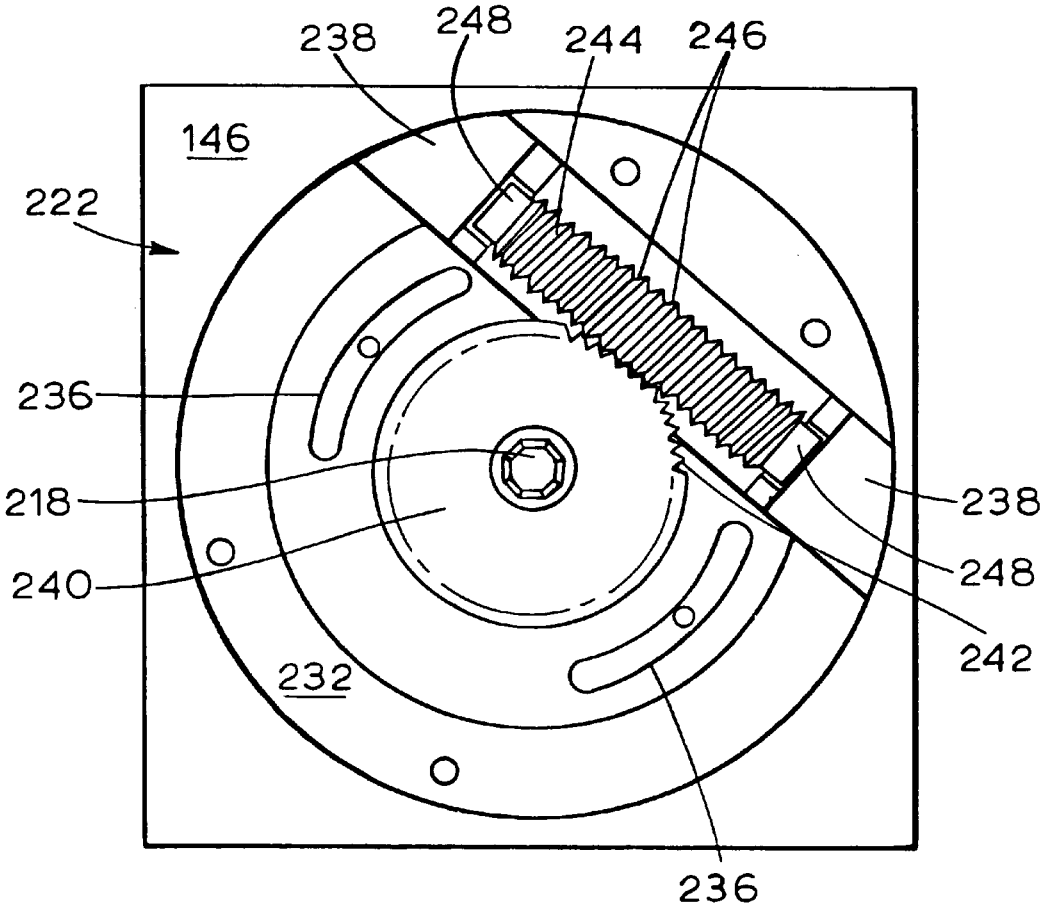
FIG. 11 is a front view of the tension adjustment mechanism of FIG. 10 with the front plate removed.

The tension adjustment mechanism 222 is shown in greater detail in FIG. 11 with the front plate 230 removed to expose the interior of the housing. The gearing is composed of a helical gear 240 mating with a worm gear 244. The helical gear 240 is mounted on the back plate 232 for rotation within the housing, and includes teeth 242 extending radially outward. The rod 218 is mounted to the helical gear 240 at the center and extends outwardly along the rotational axis of the helical gear 240.

The worm gear 244 is mounted for rotation within the housing between the access openings 238. The worm gear 244 includes outer helical threads 246 that mesh with the teeth 242 of the helical gear 240. The worm gear 244 has sockets 248 at either end adapted to receive and engage a tool that is inserted into the corresponding access opening 238. Alternatively, the sockets 248 may be replaced with hex heads that extend into the access openings 238 and are engaged by a socket tool and rotated manually or by a power assist.

During the normal operation of the shutter 134, the rod 218 is held in place by the gearing of the tension adjustment mechanism 222 and the shutter support member 136 rotates as the shutter 134 is rolled and unrolled. The tension of the torsion spring 220 is adjusted while the shutter 134 and shutter support member 136 are stationary, preferably in the rolled position. A tool is inserted into one of the access openings 238 until the tool engages the corresponding socket 248. Access to the interior of the housing is provided either by removing the front and bottom housing portion or by providing an opening in the bottom of the housing for insertion of the tool. Once the tool engages the socket 248, turning the tool in either direction causes the gearing to turn the rod 218. Turning the tool in one direction will cause the rod 218 to increase the number of turns of the torsion spring 220, thereby increasing the tension on the torsion spring 220 and, consequently, the torque exerted on the shutter 134 and shutter support member 136. Turning the tool in the opposite direction will cause the rod 218 to reduce the number of turns on the torsion spring 220 and the torque exerted on the shutter 134 and the shutter support member 136. It will be apparent to those of ordinary skill in the art that the tension adjustment mechanism 222 according to the present invention facilitates fine adjustment of the torsion spring 220 in increments of a partial rotation of the rod 218.

Figure 12:
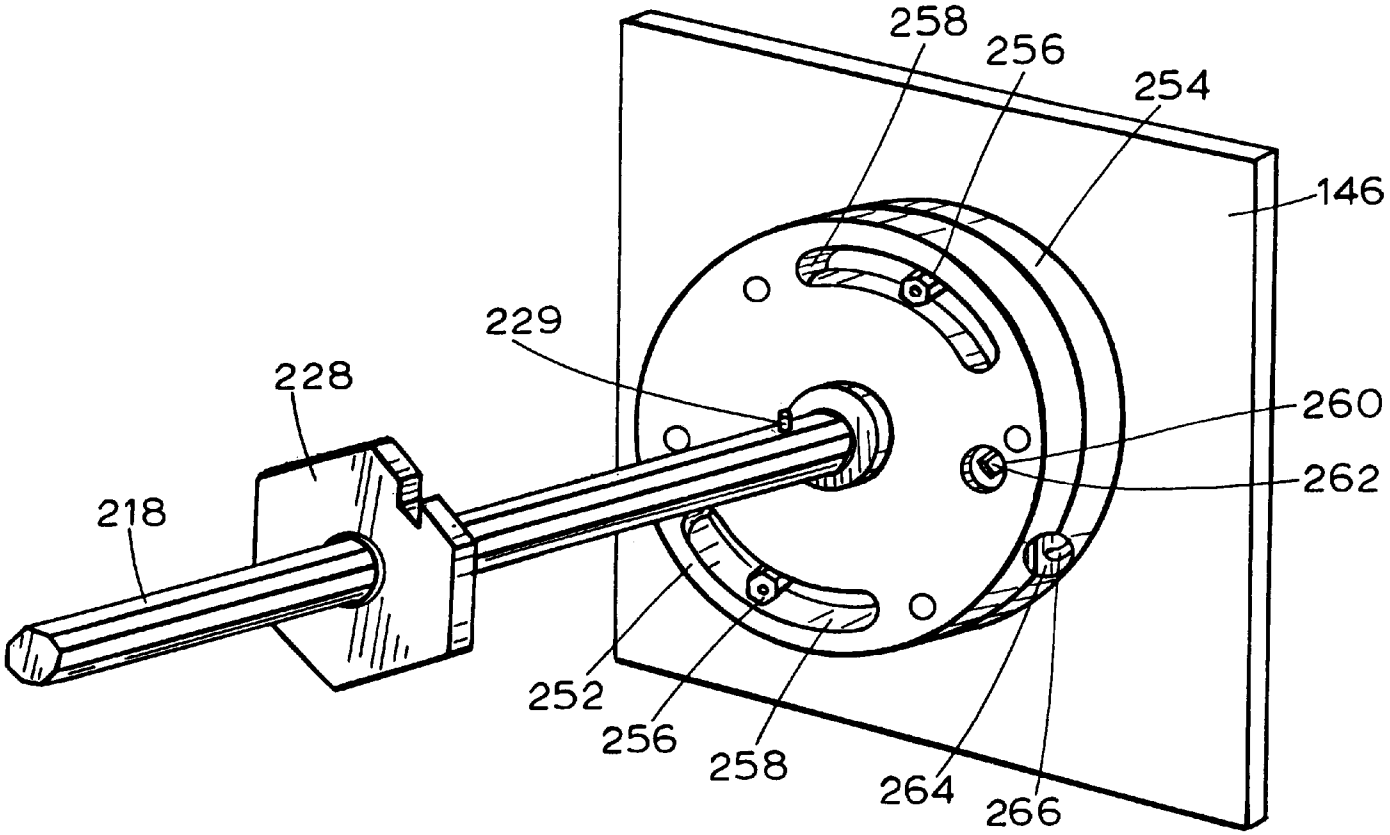
FIG. 12 is an isometric view of a mounting assembly for the modular shutter housing of FIG. 7 including an alternative embodiment of a tension adjustment mechanism according to the present invention.
Figure 13:
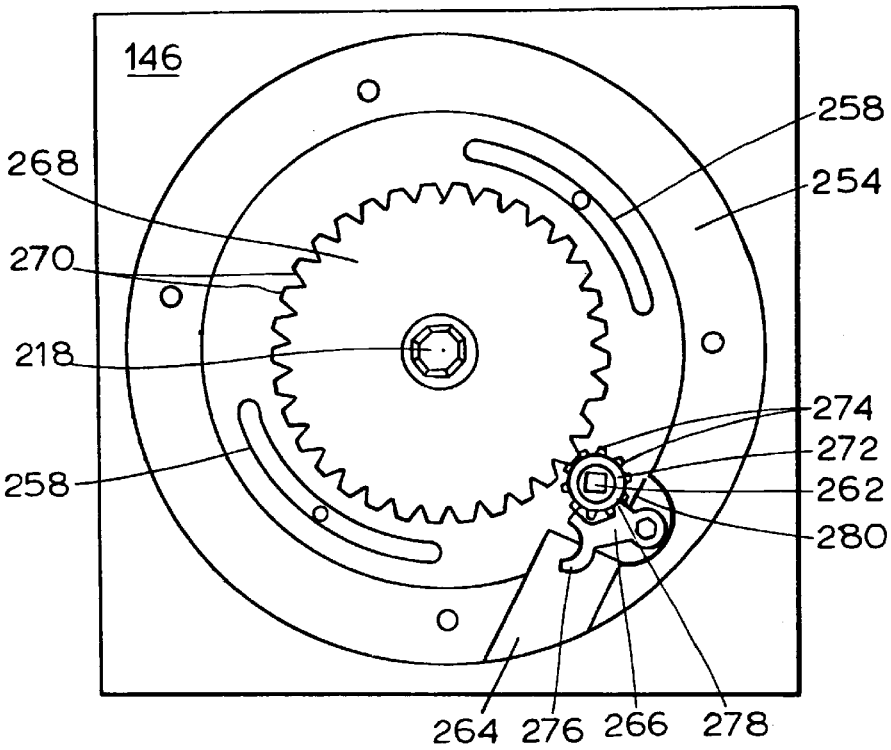
FIG. 13 is a front view of the tension adjustment mechanism of FIG. 12 with the front plate removed and in the locked position.
Figure 14:
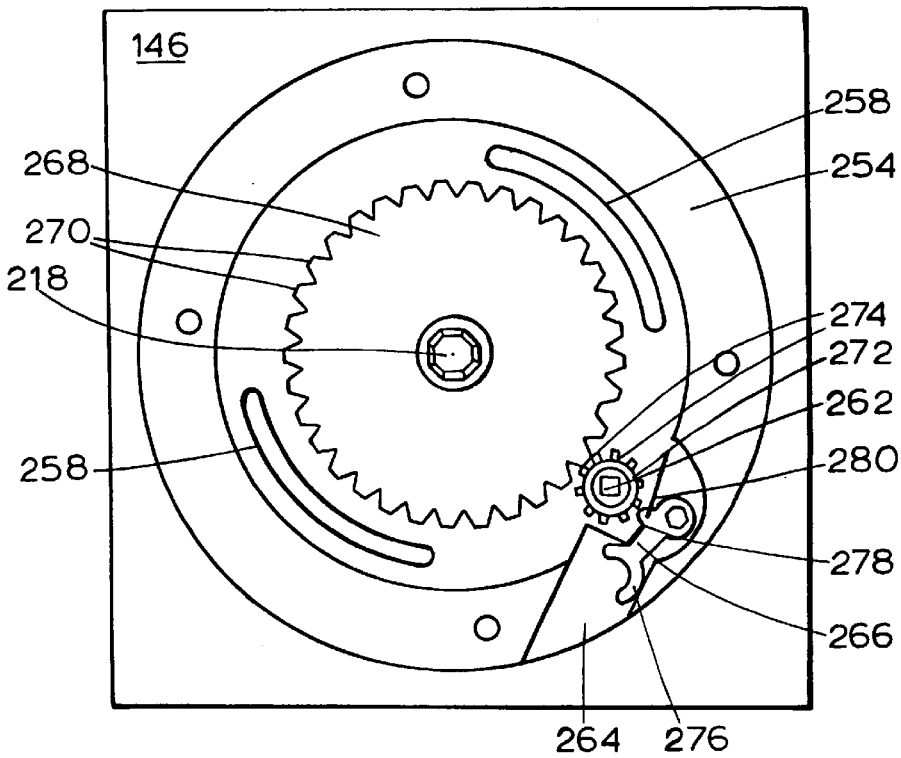
FIG. 14 is a front view of the tension adjustment mechanism of FIG. 12 with the front plate removed and in the unlocked position.

FIGS. 12–14 shown an alternative embodiment of a tension adjustment mechanism 250 according to the present invention. The tension adjustment mechanism 250 is composed of a disk-shaped housing formed by a front plate 252 that mates with a back plate 254, with the rod 218 extending outwardly from the center of the front plate 252. The front and back plates 252, 254 enclose gearing on which the rod 218 is mounted and that is discussed in greater detail below. The tension adjustment mechanism 250 is mounted to the support plate 146 by a pair of bolts 256 passing through arc-shaped channels 258 in the front and back plates 252, 254.

To provide access for operation of the tension adjustment mechanism 250, the front plate 252 has an opening 260 on the flat surface that exposes a socket 262 into which a tool is inserted to drive the gearing. The socket 262 has in interior surface adapted to receive and engage the tip of the tool or, alternatively, may have a tip adapted to be received by a socket end of the tool. An access opening 264 located on the outer edge of the tension adjustment mechanism 250 is adapted to provide access to a retaining flapper 266 disposed therein. The retaining flapper 266 locks and unlocks the gearing in a manner described below.

The tension adjustment mechanism 250 is shown in detail in FIGS. 13 and 14 with the front plate 252 removed to expose the interior of the housing. The gearing is composed of a driven gear 268 mating with a drive gear 272. The driven gear 268 is mounted on the back plate 254 for rotation within the housing, and includes teeth 270 extending radially outward. The rod 218 is mounted to the driven gear 268 at the center and extends outwardly along the rotational axis of the driven gear 268.

The drive gear 272 is mounted for rotation within the housing with a rotational axis parallel to the rotational axis of the driven gear 268. The drive gear 272 includes teeth 274 extending radially outward that mesh with the teeth 270 of the driven gear 268. The drive gear 272 has a socket 275 mounted thereon such that the longitudinal axis of the socket 262 is coincident with the rotational axis of the drive gear 268.

The retaining flapper 266 is pivotally mounted for movement within the housing and includes a trigger 276 disposed within the access opening 264 and a locking member 278. The retaining flapper 266 pivots between a locked position (FIG. 13) and an unlocked position (FIG. 14). In the locked position, the locking member 278 engages the drive gear 272 in the gap between two adjacent teeth 274 to prevent rotation of the gears 268, 272. In the unlocked position, the locking member 278 is disengaged from the teeth 274 of the drive gear 272 so that the gears 268, 272 and, consequently, the rod 218 are free to rotate. The retaining flapper 266 is biased toward the locked position by a spring 280 that is connected between the locking member 266 and the back plate 254.

During the normal operation of the shutter 104, the retaining flapper 266 is in the locked position so that the gears 268, 272 hold the rod 218 in place as the shutter support member 136 rotates during the rolling and unrolling of the shutter 134. The tension of the torsion spring 220 is adjusted while the shutter 134 and shutter support member 136 are stationary. A tool is inserted into the opening 260 until the tool engages the socket 262. Once the tool engages the socket 248, the person adjusting the tension inserts his/her finger into the access opening 264 and pulls the trigger 276 to rotate the retaining flapper 266 to the unlocked position, thereby permitting rotation of the gears 268, 272.

Turning the tool in one direction will cause the rod 218 to increase the number of turns of the torsion spring 220, thereby increasing the tension on the torsion spring 220 and, consequently, the torque exerted on the shutter 134 and shutter support member 136. Turning the tool in the opposite direction will cause the rod 218 to reduce the number of turns on the torsion spring 190 and the torque exerted on the shutter 134 and the shutter support member 136. When the torsion spring 220 is adjusted to the desired tension, the trigger 276 is released to allow the retaining flapper 266 to pivot back to the locked position under the biasing of the spring 280. In this embodiment, the tension in the torsion spring 220 is adjustable in increments of the rotation of the drive gear 272 from one gap to the adjacent gap.

In installations requiring larger and/or heavier shutters, a larger torsion spring 220 is used to exert a greater torque to assist in lifting the shutter 134 from the unrolled position. In such instances, the torque exerted by the torsion spring 220 may be strong enough to shear off the teeth of the gears in the tension adjustment mechanisms 222, 250. Therefore, it is desirable to provide additional support for the rod 218 against the torque exerted by the torsion spring 220 during the normal operation of the shutter assembly 130.

Figure 15:
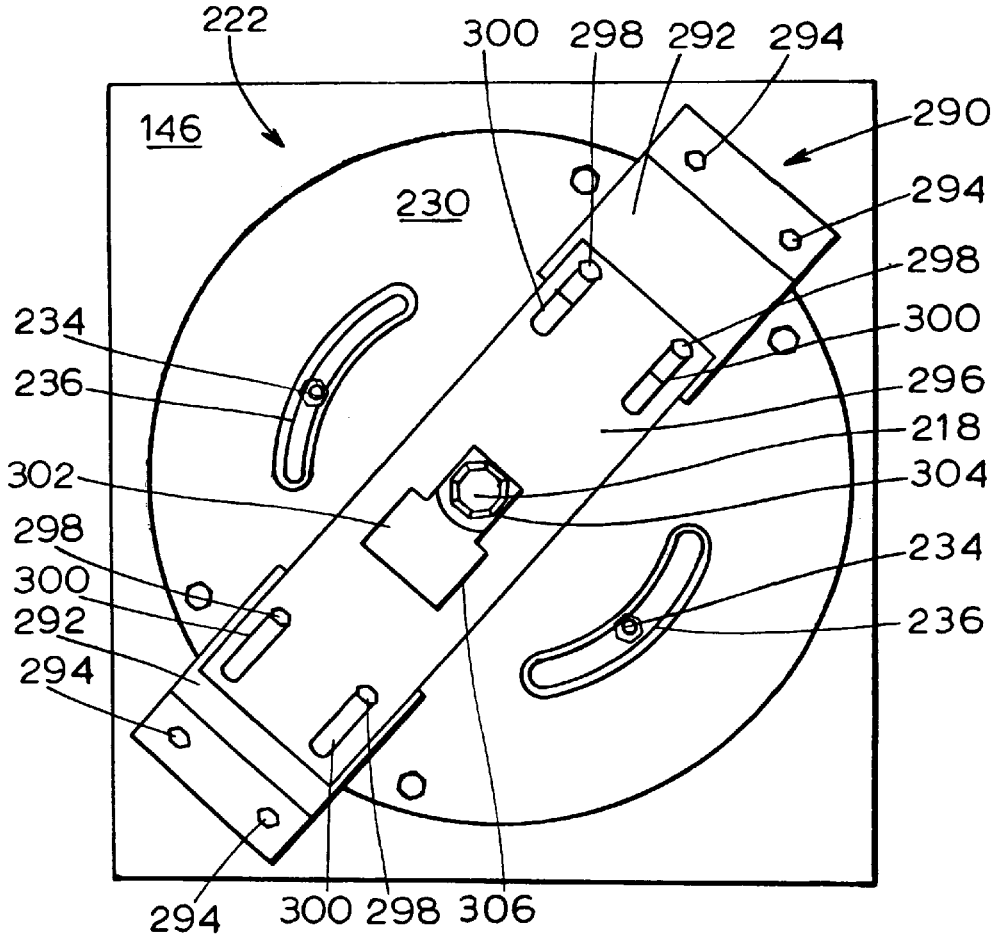
FIG. 15 is a front view of a tension adjustment mechanism including a rod-locking mechanism according to the present invention in the locked position.
Figure 16:
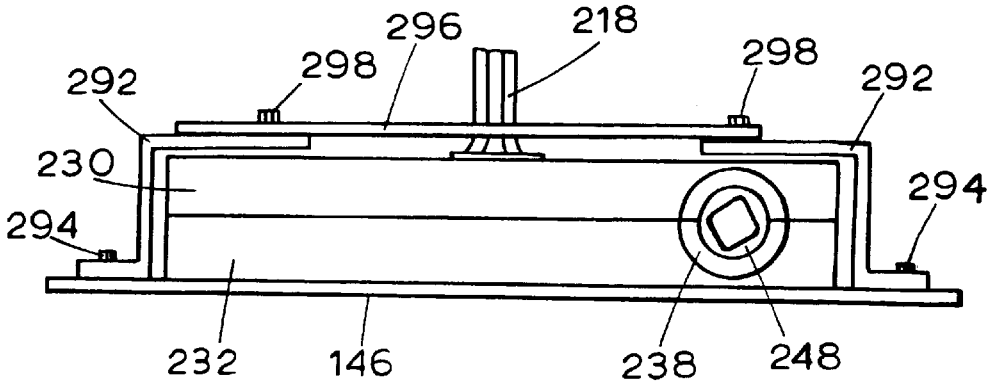
FIG. 16 is a side view of the tension adjustment and rod-locking mechanism of FIG. 15.

FIGS. 15–18 illustrate one embodiment of a rod locking mechanism 290 according to the present invention. Referring to FIGS. 15–16, the rod locking mechanism 290 is shown in the locked position. The locking mechanism 290 includes a pair of brackets 292 mounted to the mounting plate 146 by fasteners 294 on opposite sides of the torsion adjustment mechanism 222, and a locking plate 296 slidably mounted to the brackets 292. The locking plate 296 is secured to the brackets 292 by a plurality of set screws 298 disposed in channels 300 in the locking plate 296.

The locking plate 296 has a key opening 302 through which the octagonal-shaped rod 218 passes. The key opening 302 has a narrow portion 304 having a width slightly greater than the thickness of the rod 218 as measured by a perpendicular line between opposite faces of the rod 218. The key opening 302 further includes a wide portion 306 having a width at least greater than the thickness of the rod 218 as measured by a line between opposite apices of the rod 218.

Figure 17:
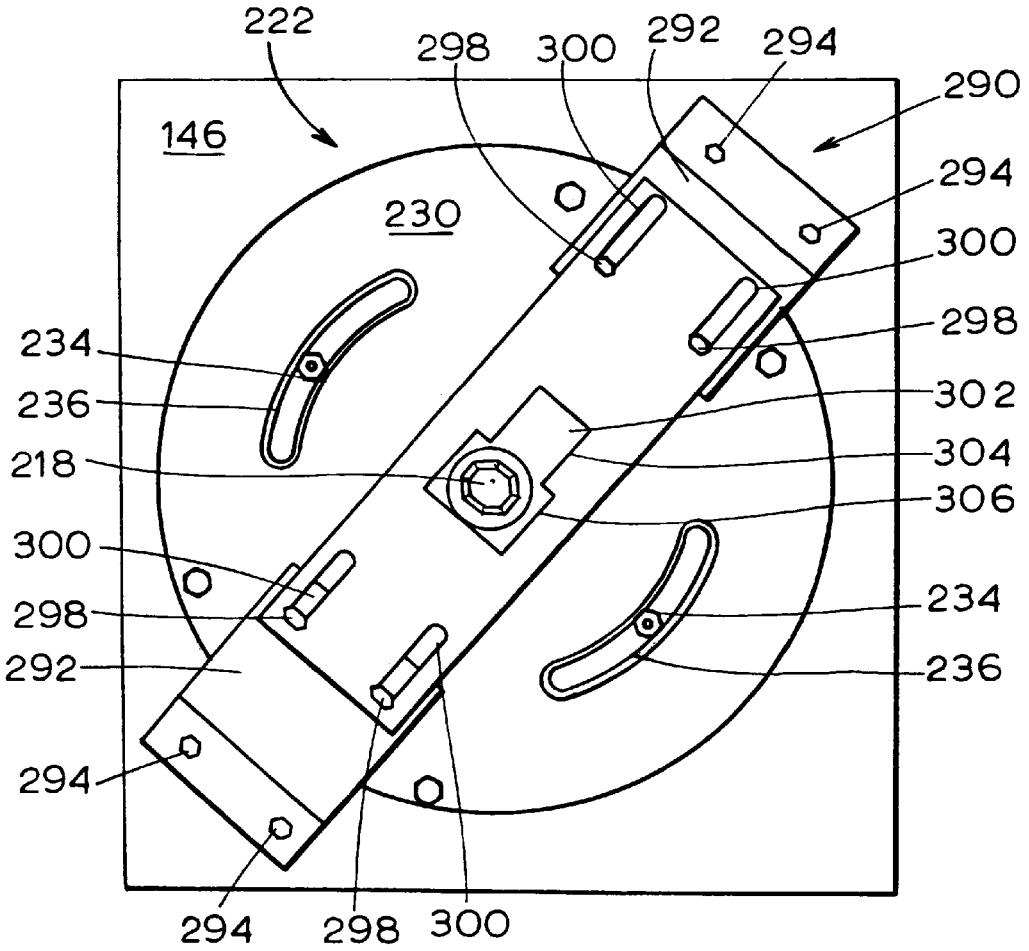
FIG. 17 is a front view of the tension adjustment and rod-locking mechanisms of FIG. 15 in the unlocked position.
Figure 18:
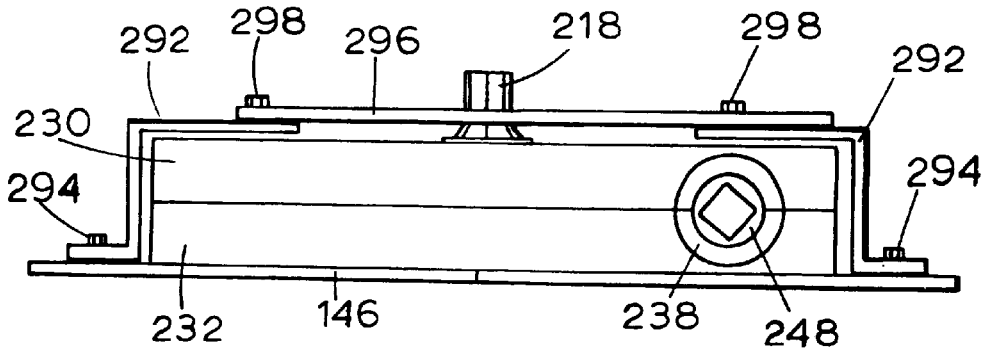
FIG. 18 is a side view of the tension adjustment and rod-locking mechanisms of FIG. 17.

The locking plate 296 slides between the locked position shown in FIGS. 15 and 16, and the unlocked position shown in FIGS. 17 and 18. Referring to FIGS. 15 and 16, the locking plate 296 slides into the locked position when two opposite faces of the rod 218 are substantially aligned with the sides of the narrow portion 304 of the key opening 302. Engaging the rod 218 in this way, the locking plate 296 holds the rod 218 stationary against the torque created by the torsion spring 220 and prevents the transmission of the torque to the gear teeth. Because the stresses on the gears are reduced, the tension adjustment mechanism 212 may be implemented using smaller gears, or gears fabricated from weaker, less expensive materials.

Referring to FIGS. 17 and 18, the locking plate 296 is shown in the unlocked position. The plate 296 is slidable when the set screws 298 are loosened to allow the screws to slide within the channels 300. In the unlocked position, the rod 218 is disposed within the wide portion 306 and is free to rotate as the tension adjustment mechanism 222 is driven in either direction. The rod 218 is rotated until the torsion spring 220 is adjusted to approximately the desired tension with a pair of opposite faces of the rod 218 aligned substantially parallel to the side walls of the narrow portion 304. When the rod 218 is repositioned, the locking plate 296 may slide back into the locked position with the rod 218 disposed within the narrow portion 304.

The rod locking mechanism 290 illustrated and described herein permits tension adjustment of the torsion spring 220 in increments of one-eighth of a rotation of the rod 218. Of course, it will be obvious to those of ordinary skill in the art that the precision of the adjustment mechanism 222 may be increased or decreased by varying the cross-sectional geometry of the rod 218 to have more or less surfaces, respectively. Additionally, alternative arrangements for mounting the rod locking mechanism are possible. For example, the brackets 292 or the locking plate 296 could be mounted directly to the housing of the tension adjustment mechanism 222. Moreover, the plate 296 could be pivotally mounted to the front plate 230 and pivot between the locked and unlocked positions. Other alternative configurations for the rod locking mechanism will be obvious to those of ordinary skill in the art and are contemplated by the inventor as having use with the present invention.

FIGS. 22–25 illustrate an alternative embodiment for an adjustment mechanism 420 that is adapted to use a detached bracket to lock the rod of the shutter support member in place. The exterior housing of the adjustment mechanism 420 is different than the housing of the mechanism 222 shown in FIG. 10, but the internal gearing arrangement for the adjustment mechanism 420 is the same as shown in FIG. 11 and described in the accompanying text. In addition, the adjustment mechanism 420 as illustrated in the drawing figures is installed in a shutter assembly utilizing a modular side assembly 400 as shown in FIG. 21.

Figure 23:
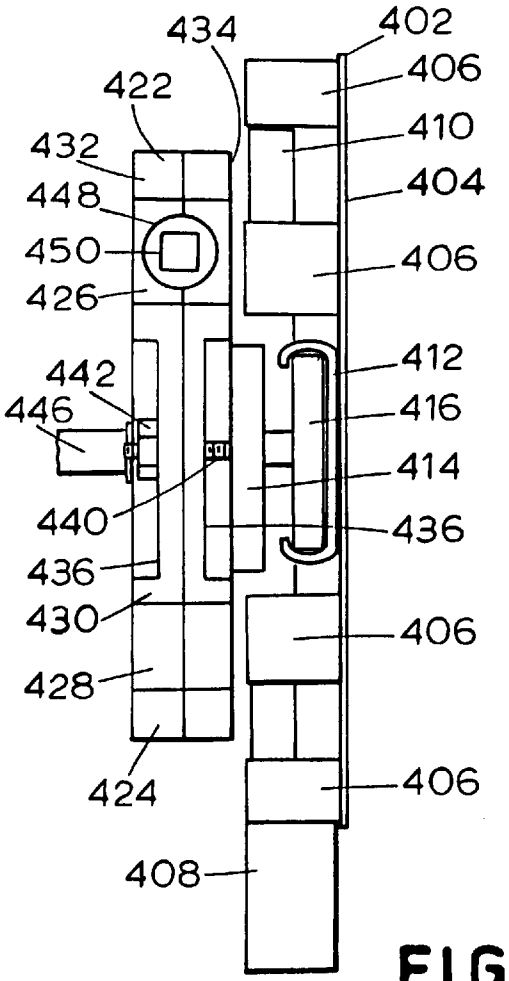
FIG. 23 is a front view of the tension adjustment mechanism of FIG. 22.
Figure 22:
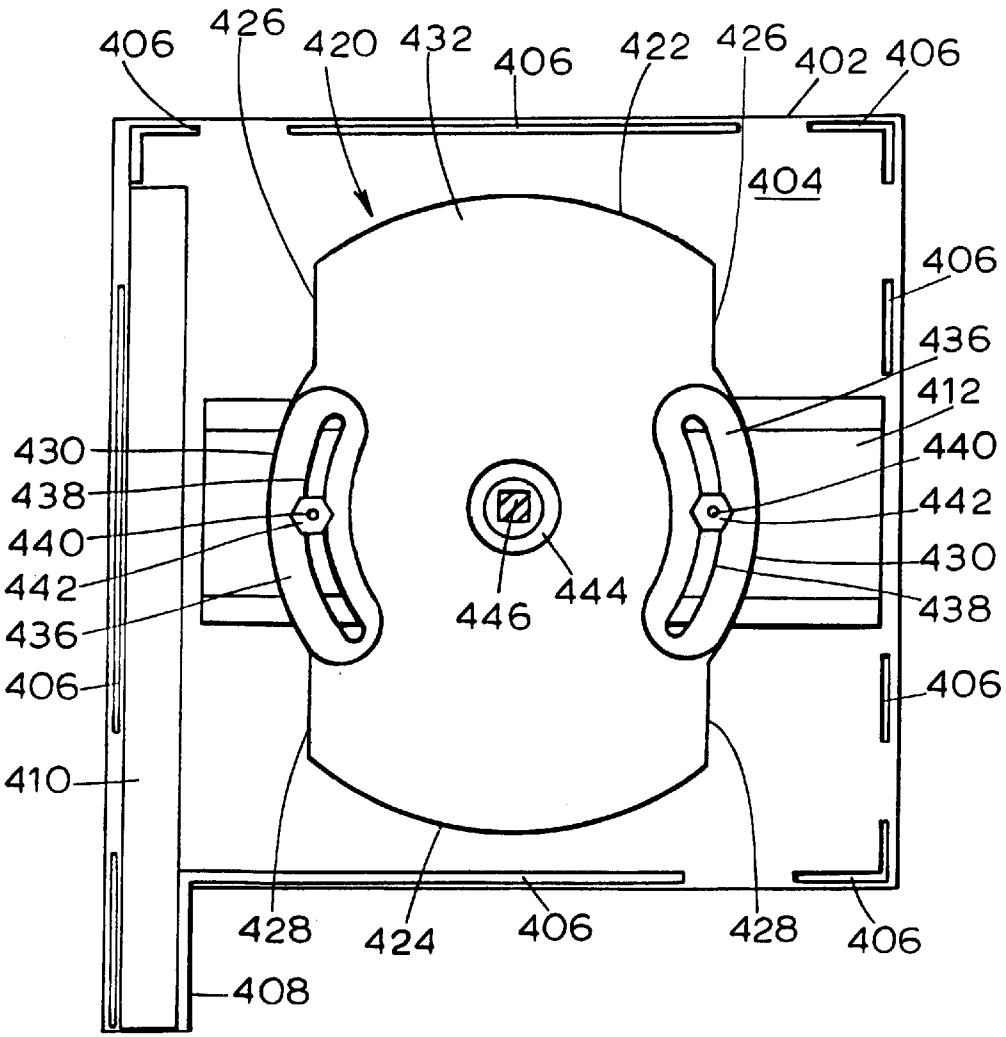
FIG. 22 is a side view of an alternative embodiment of a tension adjustment mechanism according to the present invention mounted on the modular side assembly of FIG. 21.

Referring to FIGS. 22 and 23, the shape of the adjustment mechanism 420 is adapted for engagement by a detached locking bracket that is more thoroughly described below. The adjustment mechanism 420 has arc-shaped top and bottom walls 422, 424, respectively, and side walls having upper and lower flat portions 426, 428, respectively, separated by arc-shaped center portions 430.

The front and rear walls 432, 434, respectively, are generally flat and include recessed portions 436 proximate the arc-shaped center portions 430 of the side walls. The front and rear walls 432, 434 further included arc-shaped channels 438 passing through the recessed portions 436. Bolts 440 pass through the channels 438 and, along with nuts 442, connect the adjustment mechanism 420 to the mounting plate 414. An opening 444 is located at the center of the front wall 432 through which a rod 446 extends from the interior of the adjustment mechanism 420. The rod 446 has a generally square cross-section and is connected to the internal gearing of the adjustment mechanism 420.

Each of the upper portions 426 of the side walls has an access opening 448 through which a tool is inserted to engage a socket 450 of the worm gear in the internal gearing. As shown in FIGS. 22 and 23, the rod 446 is free to rotate when the tool is used to drive the gearing of the adjustment mechanism 420. As previously discussed, the tension in the torsion spring within the shutter-support member is adjusted by using the adjustment mechanism 420 to rotate the rod 446.

Figure 25:
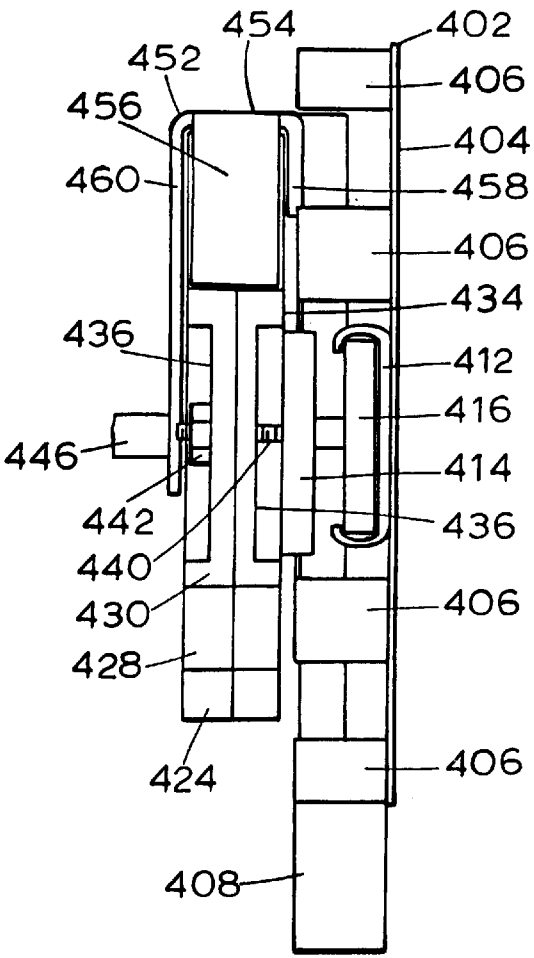
FIG. 25 is a front view of the tension adjustment and rod locking mechanisms of FIG. 24.
Figure 24:
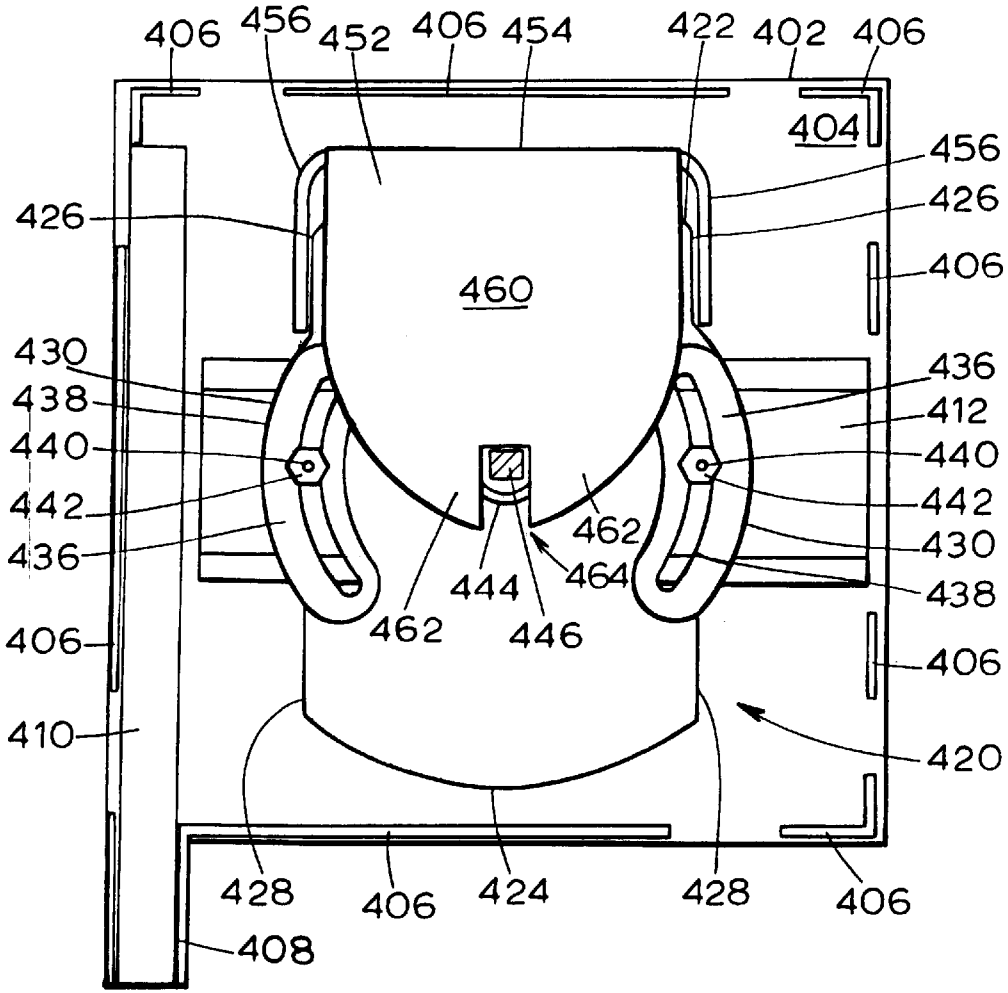
FIG. 24 is a side view of the tension adjustment mechanism of FIG. 22 engaged by an alternative embodiment of a rod locking mechanism according to the present invention.

Once the tension in the torsion spring is adjusted, the rod 446 must be locked in place to prevent damage to the gearing when the shutter is unrolled and the tension on the torsion spring increases. As shown in FIGS. 24 and 25, the rod 446 is locked by slipping a locking bracket 452 over the top of the adjustment mechanism 420. The locking bracket 452 includes a top wall 454 with downwardly extending side walls 456, rear wall 458, and front wall 460. The end of the front wall 460 includes two downwardly extending prongs 462 that define a gap 464. The width of the gap 464 is slightly larger than the perpendicular distance between two opposite sides of the rod 446.

The locking bracket 452 can slip onto the adjustment mechanism 420 when the rod 446 is rotated such that the faces of the rod 446 are vertical and horizontal. Consequently, the tension on the torsion spring can be adjusted in increments of one-quarter turn of the rod 446. Of course, finer adjustment of the spring is possible using a rod with a hexagonal or octagonal cross-section (not shown). When the locking bracket 452 is in place, the rod 446 is disposed within the gap 464 between the prongs 462. If the rod 446 begins to rotate, the sides of the rod 446 engage the inside edges of the prongs 462. At the same time, the side walls 456 of the locking member 452 engage the side walls 426 of the adjustment mechanism 420 to prevent rotation of the locking member 452 and, consequently, the rod 446 under the torque on the rod 446. When the tension on the torsion spring requires adjustment, the locking bracket 452 is removed, thereby leaving the rod 446 free to rotate.

The modular shutter assembly 130 as described offers several advantages over previously known shutter assemblies. The overall strength of the shutter assembly 130 is increased by securing the shutter housing 140 to the upward extension 160 of the shutter track 72. In previously known shutters, the shutter housing and side tracks are secured to the wall separately with the nipple aligning the tracks and providing minimal structural support. In some installations, such as those in which the housing anchored to drywall and not into studs, a high risk exists that the housing will pull out of the drywall under the weight of the shutter and the nipple will not be able to support the shutter housing. One solution is to add braces extending from the bottom of the end caps to the side tracks. However, the side tracks 72 in the shutter assembly 130 provide the support necessary for the shutter housing 140 without additional external parts that reduce the aesthetic appeal of the enclosed shutter assembly.

A further advantage of the modular shutter assembly 130 is easier installation and maintenance of the shutter assembly than previous shutter assemblies. Presently, shutter assemblies are shipped with the shutter mounted in the housing. The shutter assembly is installed by connecting the side tracks to the shutter housing to form the frame and tipping the frame up against the wall around the opening. In some applications, the shutter and shutter support member alone weigh over three hundred pounds, making installation of the combined shutter, shutter housing, and side tracks awkward and dangerous. Conversely, the modular shutter assembly 130 is installed with the cassette and, consequently, the weight of the shutter removed from the shutter housing 140. Once the side tracks 72 and shutter housing 140 are mounted on the wall, the cassette is easily installed by sliding the mounting plates 146 into the end caps 142. Additionally, when the assembly 130 is installed, no measurements are required in the field. The housing 140 and cassette are prefabricated to the appropriate lengths so the installers can install the cassette in the housing 140 without measuring or adjusting the distance between the end caps 142.

If maintenance is required on the shutter 134, the cassette is easily removed from the shutter housing 140 and repairs can be performed at ground level. Additionally, the components of the shutter may be replaced independently. For example, the tension adjustment mechanism 222 may be replaced without the necessity of replacing the torsion spring 220 and vice versa.

Yet another advantage of the shutter assembly 10 according to the present invention is the reduction or elimination of rust and corrosion of the shutter housing 140. In previous shutter assemblies, holes are drilled in the housing walls and end caps to connect the walls, the end caps and the shutters together with bolts and/or screws. The fasteners are typically fabricated from a different metal than the cast end caps and the sheet metal housing walls. When rain water collects in the recesses created around the securely fastened screws, a bi-metallic reaction occurs between the metal of the screws and the metal of the housing walls and/or the end caps that corrodes the components. The problem is especially prevalent in areas surrounding salt water lakes and oceans. The shutter assembly 130 according to the present invention reduces or eliminates rust and corrosion caused by bi-metallic reactions because the housing walls and end caps are not penetrated and the bare metal is not exposed to the environment. By reducing rust and corrosion, the modular shutter assembly according to the present invention may significantly reduce the cost and amount of maintenance and increase the overall life expectancy of the rolling protective shutters.

The embodiments disclosed herein illustrate the various aspects of the present invention applied to a rolling protective shutter. It will be apparent to those skilled in the art that the present invention may be applied to other systems wherein a partition member is coupled to a support member and rolled up into a housing. Such partition systems include roll-up doors, roll-up grills, roll-up gates and the like. The application of the present invention to the various types of roll-up partition systems is contemplated by the inventor.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A roll-up partition assembly, comprising:

a partition support member;

a partition member coupled to said partition support member;

a pair of side tracks;

a rod disposed within and coaxial with said partition support member;

a torsion spring disposed between said rod and said partition support member and having a first end coupled to said rod and a second end coupled to said partition support member;

a tension adjustment mechanism having a housing and an internal mechanism coupled to said rod, said tension adjustment mechanism being adapted to rotate said rod with respect to said partition support member; and a locking member demountably attached to said housing of said tension adjustment mechanism, said locking member adapted to engage said rod when said locking member is attached to said housing to prevent rotation of said rod and to disengage said rod when said locking member is detached from said housing;

said partition member and said partition support member being adapted to roll said partition member from an unrolled position in which said partition member is disposed in said side tracks to a rolled position in which said partition member is rolled up on said partition support member;

said locking member engaging said rod to transmit torque from said torsion spring to said housing and to prevent transmission of torque from said torsion spring to said internal mechanism.

2. An assembly as defined in claim 1, wherein said rod is demountably coupled to said internal mechanism.

3. An assembly as defined in claim 1, wherein said internal mechanism comprises:

a driven gear rotatably mounted within said housing and having said rod coupled thereto; and a drive gear rotatably mounted within said housing and adapted to mate with said driven gear.

4. An assembly as defined in claim 3, wherein said driven gear is a helical gear and said drive gear is a worm gear.

5. An assembly as defined in claim 3, wherein said driven and said drive gears are spur gears.

6. An assembly as defined in claim 1, wherein said partition member is a shutter comprising a plurality of individual slats and a plurality of hinges interconnecting said slats.

7. A roll-up partition assembly for covering an opening, comprising:

a housing adapted to be installed above said opening, said housing having a pair of end caps disposed at either end, said end caps each comprising:

an end plate, an end cap track mounted on the inward side of said end plate, and a detachable front support wall;

a partition cassette mounted within said housing, comprising:

a pair of mounting plates, each mounting plate having a pair of rollers pivotally mounted thereon, a partition support member rotatably mounted between said mounting plates, and a partition member coupled to said partition support member;

a pair of side tracks adapted to be installed on either side of said opening;

said partition member and said partition support member being adapted to roll said partition member from an unrolled position in which said partition member is disposed in said side tracks to a rolled position in which said partition member is rolled up on said partition support member;

said housing being adapted to receive said rollers to retain said partition cassette within said housing and to disengage said mounting plates to allow removal of said partition cassette without uninstalling said housing and said side tracks.

* * * * *